US007289747B2

(12) United States Patent
Miyamoto et al.

(10) Patent No.: US 7,289,747 B2
(45) Date of Patent: Oct. 30, 2007

(54) IMAGE FORMING APPARATUS

(75) Inventors: Satoru Miyamoto, Nagano (JP); Yuichi Segawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/238,681

(22) Filed: Sep. 29, 2005

(65) Prior Publication Data

US 2006/0072933 A1 Apr. 6, 2006

(30) Foreign Application Priority Data

Sep. 29, 2004 (JP) ..... 2004-283657
Sep. 29, 2004 (JP) ..... 2004-283658
Sep. 29, 2004 (JP) ..... 2004-283662

(51) Int. Cl.
*G03G 21/20* (2006.01)
*G03G 15/01* (2006.01)

(52) U.S. Cl. ..... 399/92; 399/93; 399/227

(58) Field of Classification Search ..... 399/92, 399/93, 227

See application file for complete search history.

(56) References Cited

FOREIGN PATENT DOCUMENTS

JP 07-271272 10/1995
JP 08050412 A * 2/1996
JP 11-073021 3/1999
JP 11-119611 4/1999
JP 11-119612 4/1999
JP 11-272029 10/1999
JP 2001-063890 3/2001
JP 2002278211 A * 9/2002
JP 2003-131546 5/2003
JP 2003-295714 10/2003

* cited by examiner

*Primary Examiner*—David M. Gray
*Assistant Examiner*—Erika J. Villaluna
(74) *Attorney, Agent, or Firm*—Hogan & Hartson LLP

(57) ABSTRACT

An electrostatic latent image is formed on an image carrier. A plurality of development cartridges include toner and are adapted to face the image carrier at a development position, respectively. The development cartridges cause the toner to adhere onto the image carrier to develop the electrostatic latent image as a toner image. A development device is configured to be rotatable around an rotational axis thereof. The development device houses the plurality of development cartridges around the rotational axis. A duct includes an inlet port through which air in the vicinity of the development position is sucked and an outlet port from which the sucked air is exhausted to the outside of the image forming apparatus. The duct covers an outer peripheral surface of the development device.

3 Claims, 16 Drawing Sheets

IMAGE FORMING APPARATUS

BACKGROUND OF THE INVENTION

The present invention relates to an image-forming apparatus, and more particularly, to an image-forming apparatus provided with an exhaust duct.

In an image-forming apparatus employing an electrophotographic recording system, an electrostatic latent image is formed through exposure on the surface of an image carrier formed from a photosensitive element. In this image-forming apparatus, the toner image formed on the surface of the image carrier, the toner image being transferred after the electrostatic latent image has been developed by use of toner, is transferred to a recording medium, such as recording paper, thereby forming an image. The electrostatic latent image can be subjected to toner development, by rotating a development roller opposing the surface of the image carrier and transferring the electrostatic latent image to an outer peripheral surface of the development roller in an adhering manner.

This image-forming apparatus adopting the electrophotographic recording system is provided with a development cartridge which houses toner in a container, along with the development roller opposing the image carrier. Some image-forming apparatus have a rotary development device capable of housing a plurality of development cartridges. In this image-forming apparatus, the rotary development device is rotated around a rotary shaft, thereby switching the development cartridge to be located at a development position where the development cartridge opposes the image carrier.

In such an image-forming apparatus, development cartridges for housing yellow (Y) toner, magenta (M) toner, cyan (C) toner, and black (K) toner are configured as development cartridges for causing toner to adhere to the surface of the image carrier, so that a rotary development device can store (carry) the development cartridges. The development cartridges are sequentially switched, thereby forming a color image on which colors of toner are superimposed. A monochrome image made of one color of toner, for instance, a black-and-white monochrome image made of black (K) toner (hereinafter also called simply a "monochrome image"), can also be formed.

In such an image-forming apparatus, development is performed by use of toner while the image carrier and the development roller are being rotated. For this reason, difficulty is encountered in transferring all particles of the toner on the outer peripheral surface of the development roller to the image carrier or recovering all particles of the toner into the development cartridge. Since the toner is in the form of fine particles, the toner often splashes and floats around a development position where the development roller opposes the image carrier, to thus accumulate or stain recording paper or the like. Therefore, there is proposed an image-forming apparatus adopting an electrophotographic recording system having an exhaust duct for sucking air in the vicinity of the development position and exhausting the sucked air (see, e.g., JP-A-2003-295714).

Recently, silencing of OA equipment has been sought. The image-forming apparatus having such a rotary development device forms an image while continually rotating the rotary development device at the time of formation of a color image. Therefore, noise stemming from driving of the rotary development device, particularly, leakage of noise from a side surface close to a position where the rotary development device is situated, raises a problem.

Moreover, in the image-forming apparatus having such a rotary development device, the toner housed in the development cartridge is greatly influenced by an environment. For instance, when an ambient temperature becomes high, a problem may arise in the quality of the toner.

In contrast, miniaturization of such office automation equipment has recently been particularly sought. Since an internal storage space of the equipment also becomes smaller, difficulty is encountered in avoiding a layout where a rotary development device housing the development cartridges becomes close to heat-producing elements.

Furthermore, as shown in FIG. 15, in the image-forming apparatus having such an exhaust duct, an exhaust duct 130 has an inlet 131 located at a position above the neighborhood of a development position where a development roller 14*c* of the rotary development device 14 opposes a photosensitive drum 12, and is provided such that a path extending from the inlet 131 to a position above the rotary development device 14 is taken as an exhaust path 132. Since an intermediate transfer belt 15 is provided at a position above the rotary development device 14, the exhaust duct 130 is also provided at a position adjacent to an intermediate transfer unit 25 which actuates the intermediate transfer belt 15.

A pair of duct plates 141*a*, 141*b* formed along an exterior surface of the rotary development device 14 oppose each other to thus form an exhaust passage of an exhaust path 132 in this exhaust duct 130. A filter 134 for adsorbing toner absorbed in sucked air is provided at any position in this exhaust path 132.

However, in such a related image-forming apparatus, the duct plate 141*a* of the exhaust duct 130 is provided separately from a unit cover 25*a* of the intermediate transfer unit 25. As shown in FIG. 16, there is adopted a structure where, when the intermediate transfer unit 25 is removed for performing maintenance of the intermediate transfer belt 15, the unit cover 25*a* is removed.

Specifically, since the exhaust duct 130 is not designed to be removed from the main body of the apparatus, the exhaust path defined between the duct plates 141*a*, 141*b* cannot be opened during the period of ordinary maintenance. Even when the sucked toner has been accumulated in the exhaust path, the toner cannot be cleaned. Therefore, on some occasions, when the image-forming apparatus has been subjected to shock during, e.g., movement, there may be a risk of the accumulated toner contaminating the inside of the apparatus.

Although FIGS. 15 and 16 show the intermediate transfer unit 25 having the unit cover 25*a*, the intermediate transfer unit is not limited to this type. An intermediate transfer unit not having the unit cover 25*a* suffers the same problem, as well. The rotary development device 14 can be removably attached while being withdrawn along the direction of a rotary shaft of the rotary development device, without regard to the exhaust duct 130.

SUMMARY

Accordingly, it is advantages of the present invention to provide an inexpensive image-forming apparatus which diminishes noise stemming from a rotary development device and can perform silent image-forming operation by diverting use of a member located in the vicinity of the rotary development device without arranging a custom-designed member for lessening the noise of the rotary development device, and which can lessen the influence of heat to toner in a rotary development device by diverting the use of members arranged around the rotary development device and without placement of a member specifically designed to block the heat imparted to the rotary development device from the environment, thereby enabling formation of a highly-reliable, high-quality image, and which facilities performance of maintenance on an exhaust duct by making the exhaust duct removable without involvement of any special work and which can provide a high-quality image in a convenient manner.

According to the present invention there is provided:

an image forming apparatus comprising: an image carrier on which an electrostatic latent image is formed; a plurality of development cartridges, each of which includes toner and is adapted to face the image carrier at a development position, and each of which causes the toner to adhere onto the image carrier to develop the electrostatic latent image as a toner image; a development device configured to be rotatable around an rotational axis thereof, the development device housing the plurality of development cartridges around the rotational axis; and a duct including an inlet port through which air in the vicinity of the development position is sucked and an outlet port from which the sucked air is exhausted to the outside of the image forming apparatus, wherein the duct covers an outer peripheral surface of the development device.

According to an aspect of the invention, the duct for the exhaust is formed so as to diminish the noise stemming from the rotary development device. Put another way, the exhaust duct is formed so as to screen the peripheral surface of the rotary development device to thus block (shield) noise. Consequently, the exhaust duct provided for absorbing the toner floating around the development position of the rotary development device is used for nose reduction, thereby lessening the noise derived from the rotary development device.

The image forming apparatus according to the invention may have the following structure in addition to the apparatus described above. More specifically, the duct extends between the development device and one of side walls of the image forming apparatus.

According to an aspect of the invention, the exhaust duct is provided at a space on the exterior cover side of the rotary development device. Consequently, when the rotary development device is driven, the amount of noise leaking out of the side section is large. However, as a result of the exhaust duct being provided inside of the side exterior cover (i.e., outside of the rotary development device), the noise stemming from the rotary development device is effectively diminished.

The image forming apparatus according to the invention may have the following structure in addition to the apparatus described above. More specifically, the duct extends along an upper side of the outer peripheral surface of the developing device.

According to an aspect of the invention, the exhaust duct covers the space above the rotary development device to the side surface of the rotary development device. Accordingly, the outer peripheral surface of the rotary development device can be concealed largely, and the noise stemming from the rotary development device is effectively reduced.

The image forming apparatus according to the invention may have the following structure in addition to the apparatus described above. More specifically, the duct includes a first path and a second path, the first path extends along an upper side of the outer peripheral surface of the developing device, the second path extends along an lower side of the outer peripheral surface of the developing device, and the first path and the second path join the outlet port.

According to an aspect of the invention, the exhaust duct is formed so as to ensure two paths, namely, an exhaust path covers a space above the rotary development device to one side surface thereof, and an exhaust path covers the other side surface of the rotary development device to a space below the rotary development device. Consequently, the substantially entire outer peripheral surface of the rotary development device can be covered, and the noise stemming from the rotary development device is effectively diminished.

The image forming apparatus according to the invention may have the following structure in addition to the apparatus described above. More specifically, the inlet port is wider than the outlet port in a direction parallel to the rotational axis.

The image forming apparatus according to the invention may have the following structure in addition to the apparatus described above. More specifically, the outlet port has a fan.

According to an aspect of the invention, the fan is provided on the side of the outlet port, the space for sucking in the exhaust duct can be prevented from being occupied by the fan.

The image forming apparatus according to the invention may have the following structure in addition to the apparatus described above. More specifically, the inside of the duct is at least partly divided by wall member into a plurality of exhaust courses.

According to an aspect of the invention, the exhaust duct is divided, to thus regulate the exhaust such that a desired flow is achieved. Consequently, the exhaust can be efficiently discharged without a loss, thereby lessening the noise stemming from the exhaust. Moreover, accumulation of heat in the exhaust duct can be prevented, thereby avoiding an increase in the temperature of the exhaust duct.

The image forming apparatus according to the invention may have the following structure in addition to the apparatus described above. More specifically, each of the exhaust courses has substantially same size in a cross section.

According to an aspect of the invention, the sucked air flows through the substantially uniformly divided exhaust courses. Put another way, air can be uniformly sucked and exhausted. Consequently, the air can be exhausted without a great difference in air-volume displacement between the courses, and the noise stemming from the exhaust can be reduced. Moreover, accumulation of heat in the exhaust duct can be prevented, thereby avoiding an increase in the temperature of the exhaust duct.

The image forming apparatus according to the invention may have the following structure in addition to the apparatus described above. More specifically, one of the exhaust courses having a larger curvature has a larger cross section.

According to an aspect of the invention, the course having a larger curvature in the exhaust duct acquires a larger flow-passage space, and the sucked air can be exhausted through the exhaust duct having a low loss. Consequently, the sucked air can be exhausted without involvement of a difference in the air-volume of displacement of the courses, thereby diminishing noise stemming from an exhaust. Moreover, accumulation of heat in the exhaust duct can be prevented, thereby avoiding an increase in the temperature of the exhaust duct.

The image forming apparatus according to the invention may have the following structure in addition to the apparatus described above. More specifically, the duct arranges between the development device and a heat source.

According to an aspect of the invention, the outer periphery surface of the rotary development device is covered by the exhaust duct so as to be screened from the heat source. Therefore, the heat produced by the heat source is received by the exhaust duct before affecting the development cartridges in the rotary development device. As a result, the heat is removed by the exhaust flowing through the exhaust duct, whereby the toner stored in the development cartridges undergoes little influence of the heat of the heat source.

The image forming apparatus according to the invention may have the following structure in addition to the apparatus described above. More specifically, the heat source includes at least one of a power source supplying power to the image forming apparatus, a scanner forming the electrostatic latent image on the image carrier, a fuser fixing the toner image onto a recording medium, and a motor operating a drive device of the image forming apparatus.

According to an aspect of the invention, in the case of a layout where a power source, which would become the heat source, is disposed around the rotary development device, the exhaust duct is set between the power source and the rotary development device. Consequently, the power source, or the like, which would become the heat source, can be laid out freely without taking into consideration the influence of heat on the toner in the development cartridges.

The image forming apparatus according to the invention may have the following structure in addition to the apparatus described above. More specifically, at least a part of the duct in proximity to the heat producing component is comprised of a thermal conductive material.

According to an aspect of the invention, the part of the exhaust duct facing the heat source has superior thermal conductivity. For instance, the exhaust duct is made from metal. Consequently, the heat produced from the heat source is efficiently absorbed, and the heat can be transferred to the air in the exhaust duct. Further, an increase in the temperature of a member located around the heat source, such as the exhaust duct, can also be prevented.

According to the Present Invention there is Provided:

an image forming apparatus comprising: an image carrier on which an electrostatic latent image is formed; a plurality of development cartridges, each of which includes toner and is adapted to face the image carrier at a development position, and each of which causes the toner to adhere onto the image carrier to develop the electrostatic latent image as a toner image; a development device configured to be rotatable around an rotational axis thereof, the development device housing the plurality of development cartridges around the rotational axis; and a duct including an inlet port through which air in the vicinity of the development position is sucked and an outlet port from which the sucked air is exhausted to the outside of the image forming apparatus, wherein at least a part of the duct is defined by a detachable unit that is located in close proximity to the development device.

According to an aspect of the invention, when the detachable unit is removed from the main body of the apparatus, at least the part of the exhaust duct is removed from the main body of the apparatus together with the detachable unit. When the detachable unit is attached to the main body of the apparatus, the exhaust duct, which has been removed together with the detachable unit, is also set in the main body of the apparatus, to thus define the exhaust duct. Consequently, during maintenance, or the like, of the detachable unit, the exhaust duct can be removed from the main body of the apparatus without involvement of specific operation for detaching the exhaust duct (without awareness of performance of any removal operation), and maintenance, such as cleaning for removal of the toner accumulated in the exhaust duct, can be carried out incidentally.

The image forming apparatus according to the invention may have the following structure in addition to the apparatus described above. More specifically, the duct is defined by a pair of opposing plates, and the detachable unit includes one of the plates so that the one of the plates is detachable from the image forming apparatus together with the detachable unit.

According to an aspect of the invention, when the detachable unit is removed from the main body of the apparatus, one of the opposing plates of the exhaust duct is removed from the main body of the apparatus together with the detachable unit, whereby the exhaust duct is opened outward. Consequently, during maintenance of the detachable unit, maintenance operation, such as removal of the toner accumulated in the exhaust duct, can be performed, thereby readily cleaning the inside of the exhaust duct.

The image forming apparatus according to the invention may have the following structure in addition to the apparatus described above. More specifically, the duct is defined by a pair of opposing plates, and the pair of opposing plates is operable to detach from the image forming apparatus together with the detachable unit.

According to an aspect of the invention, when the detachable unit is removed from the main body of the apparatus, both of the opposing plates of the exhaust duct are removed together from the main body of the apparatus. Consequently, during maintenance of the detachable unit, the opposing plates can be disassembled or cleaned at a position remote from the location where the main body of the apparatus is installed, or can be inserted into a cleaning machine. Thus, when the detachable unit is exchanged, the opposing plates can be exchanged along with the detachable unit. Consequently, there is no risk of the main body of the apparatus being contaminated, and hence the inside of the exhaust dect can be made clean without accumulated toner.

The image forming apparatus according to the invention may have the following structure in addition to the apparatus described above. More specifically, the duct has a filter therein, the filter absorbs toner included in the sucked air, and the filter is operable to detach from the image forming apparatus together with the detachable unit.

According to an aspect of the invention, when an adjacent unit is removed from the main body of the apparatus, the filter provided in the exhaust duct is also removed from the main body of the apparatus along with the detachable unit. Consequently, during maintenance of the detachable unit, the filter can be cleaned or exchanged at a position remote from the location where the main body of the apparatus is installed. Therefore, there is no risk of the main body of the apparatus being contaminated, and hence an image can be formed in a clean environment by recovering an exhaust capability.

As mentioned above, the exhaust duct screens the outer peripheral surface of the rotary development device so as to block the noise stemming from the rotary development device. Hence, the noise stemming from the rotary development device can be diminished by use of the exhaust duct which sucks air in the vicinity of the development position and exhausts the sucked air. Occupation of a space, which would otherwise be required by a custom-designed sound insulation member, or occurrence of a cost hike can be prevented, and noise can be effectively diminished. Consequently, an inexpensive image-forming apparatus capable of silently forming an image can be provided.

Further, since the exhaust duct screens the outer peripheral surface of the rotary development device from the heat source, the heat generated by the heat source can be removed before affecting the development cartridges in the rotary development device by means of the exhaust flowing through the exhaust duct. Thus, the chance of the toner stored in the development cartridges being affected by the heat of the heat source can be eliminated. Consequently, there can be prevented occupation of a space, which would otherwise be caused by a custom designed heat insulation member, or occurrence of a cost hike. A high quality image can be reliably formed by effectively reducing the influence of the heat source on toner.

Furthermore, at least a part of the exhaust duct can be detached from the main body of the apparatus together with the detachable unit. Accordingly, concurrently with maintenance of the detachable unit, maintenance operation for removing the toner accumulated in the exhaust duct can be performed. Consequently, maintenance can be performed along with maintenance of the detachable unit without awareness of any operation for detachment of the exhaust duct, thereby easily rendering the inside of the exhaust clean. Contamination of the inside of the main body of the apparatus is prevented, thereby enabling convenient formation of a high-quality image in a clean environment.

DETAIL DESCRIPTION OF PREFERRED EMBODIMENTS

Best modes for implementing the present invention will be described hereinbelow by reference to the drawings. FIGS. 1 to 6 are drawings showing a first embodiment of an image-forming apparatus according to the present invention.

Figure 1:
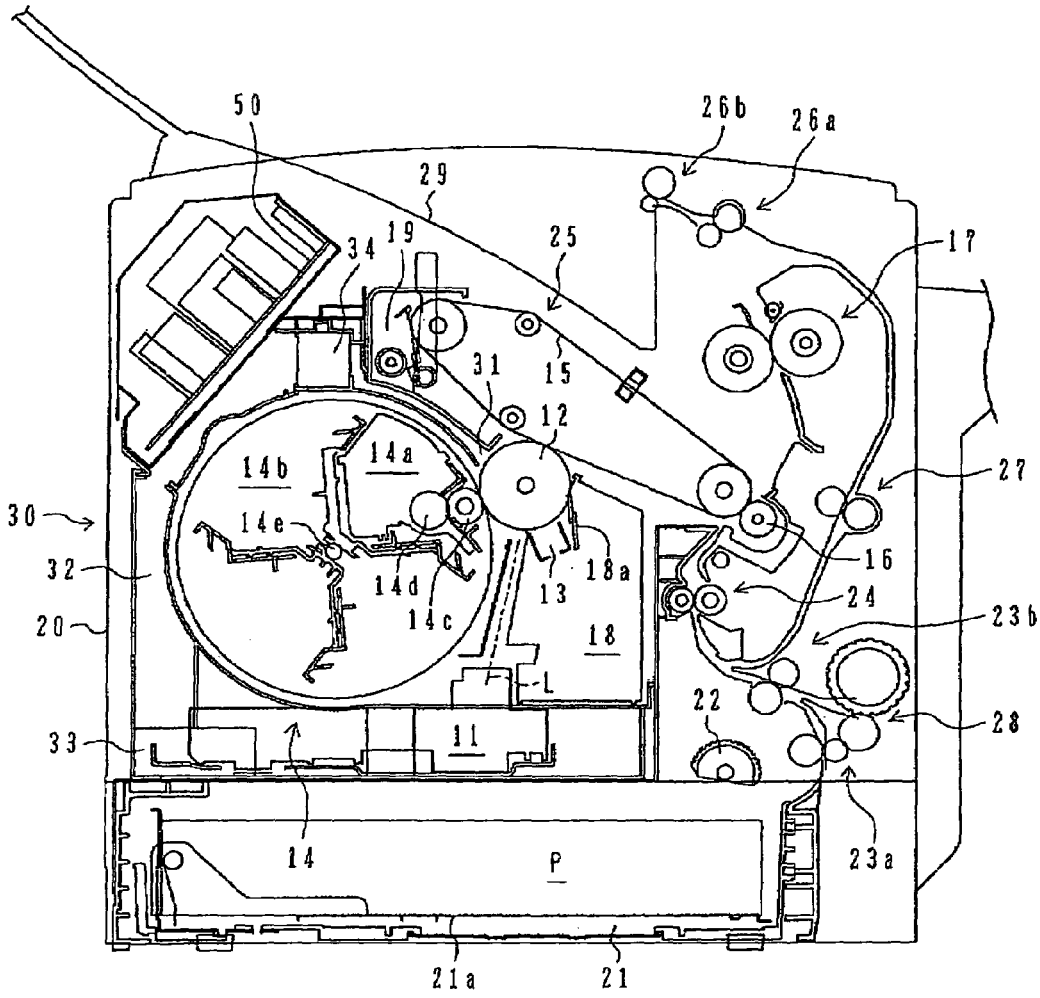
FIG. 1 is a view showing an embodiment of an image-forming apparatus according to the present invention, or a perspective front view showing the schematic entire of the image-forming apparatus.

In FIG. 1, an image-forming apparatus is a printer which is utilized while being connected to an external device, such as a personal computer, which prepares and outputs images, such as characters. This image-forming apparatus comprises an image recorder which receives image data pertaining to a target image to be formed as an image, such as characters, and records and forms the image on one or both surfaces of recording paper P (a recording medium) by means of electrophotography; and a paper transporter which transports a plurality of sheets of loaded recording paper P to the image recorder and also transports, to the outside of the image-forming apparatus in a stacking manner, the recording paper P on which an image has been recorded and formed.

Briefly, the image recorder comprises a laser beam scanner (scanner unit) 11 for causing a laser beam L to scan on the basis of image data; a photosensitive drum (image carrier) 12 which is exposed to scanning of the laser beam L output from the laser beam scanner 11 and on whose surface an electrostatic latent image based on image data pertaining to a target image is formed through exposure; an electrification device 13 which electrifies the outer peripheral surface of the photosensitive drum 12 so that an electrostatic latent image can be formed through exposure to the laser beam L; development cartridges 14*a* of respective colors which store yellow (Y) toner, cyan (C) toner, magenta (M) toner, and black (K) toner and which, in cooperation with a developing device, develop the electrostatic latent image on the photosensitive drum 12 by use of toner; a rotary development device 14 which houses the development cartridges 14*a* into loading spaces 14*b* of respective colors and causes the development cartridges 14*a* to operate; an intermediate transfer belt (an intermediate transfer medium) 15 which can receive a toner image (a monochrome image or a color image) of a target image developed on the photosensitive drum 12 and forms a toner image capable of being transferred or recorded to the recording paper P and record the same thereon; a transfer roller 16 which transports the transported recording paper P downstream while nipping the recording paper P between the transfer roller 16 and the intermediate transfer belt 15 and which transfers the toner image of the target image carried by the intermediate transfer belt 15 onto the nipped and transported recording paper P; a pair of fusing rollers 17 which subject, to heating and pressurization, the transported recording paper P with the toner image of the target image transferred thereon, to thus fix the toner image on the surface of the recording paper, and which transport the recording paper P further downstream in a nipped manner; a waste toner tank 18 which recovers the toner still remaining on the photosensitive drum 12 through use of a blade 18*a* and stores the thus-recovered toner; and a waste toner tank 19 which similarly recovers the toner still remaining on the intermediate transfer belt 15 by use of a blade and stores the thus-recovered toner. The intermediate transfer belt 15, the transfer roller 16, and the pair of fusing rollers 17 also have the function of transporting the recording paper P. For these reasons, they constitute a part of the paper transporter to be described below, as well.

Briefly, the paper transporter comprises a paper cassette 21 which is removably set in a lower portion of the apparatus main body and loads a plurality of sheets of recording paper P; a pickup roller 22 which rotates while remaining in pressed contact with a bundle of sheets of recording paper P lifted by an elevation plate 21*a* which serves as a bottom surface of the paper cassette 21, to thus withdraw the topmost sheet of recording paper P and send the thus-drawn sheet of paper to a transport path; a pair of relay transport rollers 23*a*, 23*b* which receive the recording paper P sent by the pickup roller 22 and transport the thus-received recording paper P to a further downstream transport path in a nipped manner; a pair of registration rollers 24 which receive the recording paper P transported through the inside of the transport path by the pair of relay transport rollers 23*a*, 23*b* and which transport the thus-received recording paper P to a position where an image is recorded and formed by the intermediate transfer belt 15 and the transfer roller 16, both belonging to the image recorder; and a pair of paper output rollers 26*a*, 26*b* which receive the recording paper P and transport and output the recording paper P on a paper output table 29 located at a position above the main body of the transport apparatus, wherein the recording paper is transported over a transport path which extends from the pair of registration rollers 24 and passes between the intermediate transfer belt 15 and the transfer roller 16, and the pair of fusing rollers 17 located at a higher position, so that a fused image is formed on one surface of the recording paper. This paper transporter has a re-transport path which inverts the recording paper P on one surface of which an image is formed and delivers the thus-inverted recording paper to the transport path upstream of the pair of registration rollers 24, and a pair of intermediate transport rollers 27 disposed along the re-transport path. The recording paper P that has been sent to the re-transport path as a result of the pair of paper output rollers 26*a*, 26*b* being inverted is received by the pair of intermediate transport rollers 27, and the thus-received recording paper is passed to the pair of registration rollers 24, whereby images can be formed on both surfaces of the recording paper P. This paper transporter has a manual-feeding transport path for delivering recording paper P inserted by way of an unillustrated manual-feeding port to the transport path located upstream of the pair of registration rollers 24, and a pair of manual-feeding transport rollers 28 disposed along the manual-feeding transport path. The pair of manual-feeding transport rollers 28 receive the manually-fed recording paper and pass the thus-received recording paper to the pair of registration rollers 24, so that an image can be formed on one surface of the recording paper P.

As a result, the image-forming apparatus causes toner to adhere to the surface of the photosensitive drum 12, thereby developing an electrostatic latent image to thus form a toner image. The toner image is transferred onto one surface or both surfaces of the recording paper P transported by way of the intermediate transfer belt 15, thereby forming images.

In this image-forming apparatus, the development cartridge 14*a* provided in the rotary development device 14 synchronously rotates a development roller 14*c* opposing the surface of the photosensitive drum 12 with a clearance therebetween, and transfers toner, in an adhering manner, to the electrostatic latent image formed on the surface of the photosensitive drum 12, thereby developing the electrostatic latent image by use of toner. A supplying roller 14*d*, which rotates within the toner storage space of the development cartridge 14*a*, rotates while remaining in pressed contact with the development roller 14*c*, thereby supplying toner. The rotary development device 14 rotates about a rotary shaft 14*e*, thereby selecting the development cartridge 14*a* caused to face the surface of the photosensitive drum 12. As a result, an image is formed by transferring onto the recording paper P a color image which has been formed by superimposing yellow (Y) toner, cyan (C) toner, magenta (M) toner, and black (K) toner on the surface of the intermediate transfer belt 15 or transferring the monochrome image formed from black (K) toner onto the recording paper P.

In this image-forming apparatus, the photosensitive drum 12 rotates clockwise in FIG. 1, whereas the development roller 14*c* of the development cartridge 14*a* rotates counterclockwise in FIG. 1. Therefore, a very small fraction of the toner which transfers from the development roller 14*c* to the photosensitive drum 12 splashes downstream in the rotational direction, to thus float. For this reason, an exhaust duct 30, whose inlet is located at a position above the vicinity of the location (development position) where the development roller 14*c* and the photosensitive drum 12 oppose each other, is disposed at a downstream position in the rotational directions thereof.

Figure 2:
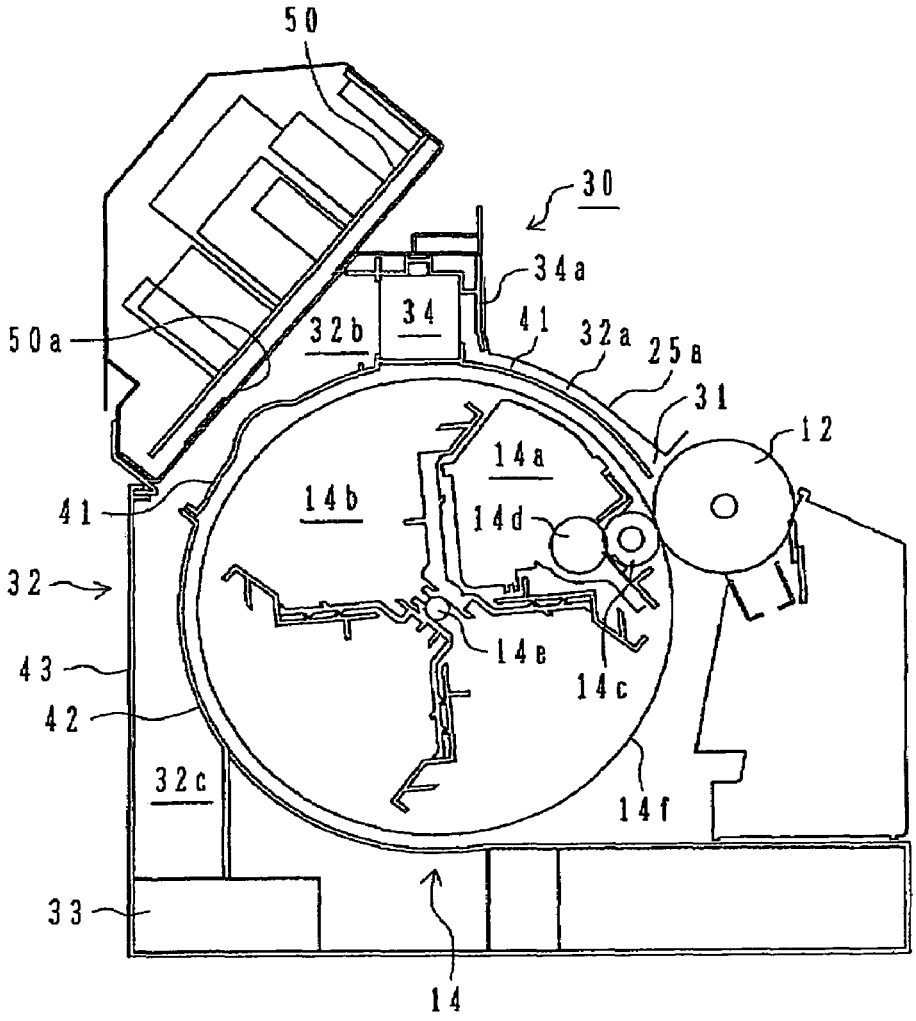
FIG. 2 is a fragmentary enlarged perspective front view showing the configuration of the image-forming apparatus.

As shown in FIG. 2, the exhaust duct 30 comprises an inlet 31 which performs sucking operation at an upper portion thereof located in the vicinity of a position where the photosensitive drum 12 and the development roller 14*c* oppose each other; namely, an upper portion thereof located in the vicinity of the development position on the rotary development device 14 close to the inside of the apparatus main body, is taken as an entrance; an exhaust path 32 defining an exhaust passage which runs from the inlet 31 toward an exterior surface cover 20 (shown in FIG. 1) on a portion of the side surface of the apparatus main body in a bypassing manner so as to cover an upper portion of the rotary development device 14 and subsequently lowers so as to run along the exterior cover 20; and an exhaust port 33 which is provided in the vicinity of a lower portion of the rotary development device 14 adjoining the side exterior cover 20 serving as an exit for discharging the air sucked by way of the exhaust path 32.

The exhaust duct 30 has a filter 34 which is provided within the exhaust path 32 above the rotary development device 14 for adsorbing toner mixed into the sucked air. Toner is removed, by means of adsorption, from the exhaust air passing through the exhaust path 32, thereby preventing contamination of the surroundings, which would otherwise be caused when toner is included in the exhaust air discharged from the exhaust port 33. A centrifugal fan 35 (shown in FIG. 5) is disposed at the exhaust port 33 of the exhaust duct 30. The air sucked by the centrifugal fan 35 through the inlet 31 in the vicinity of the development position by way of the inlet 31 is exhausted from the exhaust port 33 after having passed through the filter 34. The filter 34 is placed in the exhaust passage of the exhaust path 32. The exhaust path 32 defines a long exhaust passage which runs from the inside of the apparatus main body of the rotary development device 14 to a position located below the side exterior cover 20 by way of an upper portion of the main body. As will be described later, the exhaust passage is narrowed so as to proceed toward the exhaust port 33. For these reasons, as compared with an axial-flow fan, the centrifugal fan 35 is more resistant to loop loss and has a more stable suction characteristic. Even when a high squeezing effect arises in the passage of the exhaust path 32, the centrifugal fan 35 can suck air from the inlet 31 without generating loud noise and exhaust the air from the exhaust port 33. This centrifugal fan 35 can be placed at the exhaust port 33, which is the long flow passage extending from the inlet 31. Therefore, a space can be ensured in the vicinity of the rotary development device 14. In the related image-forming apparatus, an axial-flow fan, or the like, has been placed in the space. This image-forming apparatus of the invention enables placement of a power board 50.

The exhaust path 32 is assembled from a first path 32*a* extending from the inlet 31 to the entrance of the filter 34; a second path 32*b* extending from the exit of the filter 34 to a position adjacent to the side exterior cover 20; and a third path 32*c* which is provided so as to be continuous with the second path 32*b* and extends up to the exhaust port 33 adjacent to the side exterior cover 20, all of these paths being designed so as to be split. A set of duct plates (opposing plates) 41 to 43, which are formed so as to extend along a rotational outer peripheral cover 14*f* of the rotary development device 14, define the exhaust path. The duct plate 41 functions also as a lower exterior portion of the filter 34.

The duct plate 41 is placed adjacently to, in a covering manner, the outer peripheral cover 14*f* located above the rotary development device 14. A transfer unit cover 25*a* of an intermediate transfer unit 25 which forms the intermediate transfer belt 15 located above the development position of the rotary development device 14 so as to be removably attach the main body of the apparatus and a power cover 50*a* having the power board 50 therein are formed continuous with an upper exterior portion 34*a* of the filter 34, and oppose the duct plate 41. Specifically, the transfer unit cover 25*a* and the power cover 50*a* oppose the duct plate 41, thereby defining the first path 32*a* and the second path 32*b*.

The duct plate 42 is placed adjacently to, in a covering manner, the side of the outer peripheral cover 14*f* of the rotary development device 14, and is provided continuous with the duct plate 41. The duct plate 43 which is provided continuous with the power cover 50*a* and to which the duct plate adjacent to the side exterior cover 20 opposes is provided so as to oppose the duct plate 42. Specifically, the duct plates 42, 43 oppose each other, thereby defining the third path 32*c*.

Figure 3:
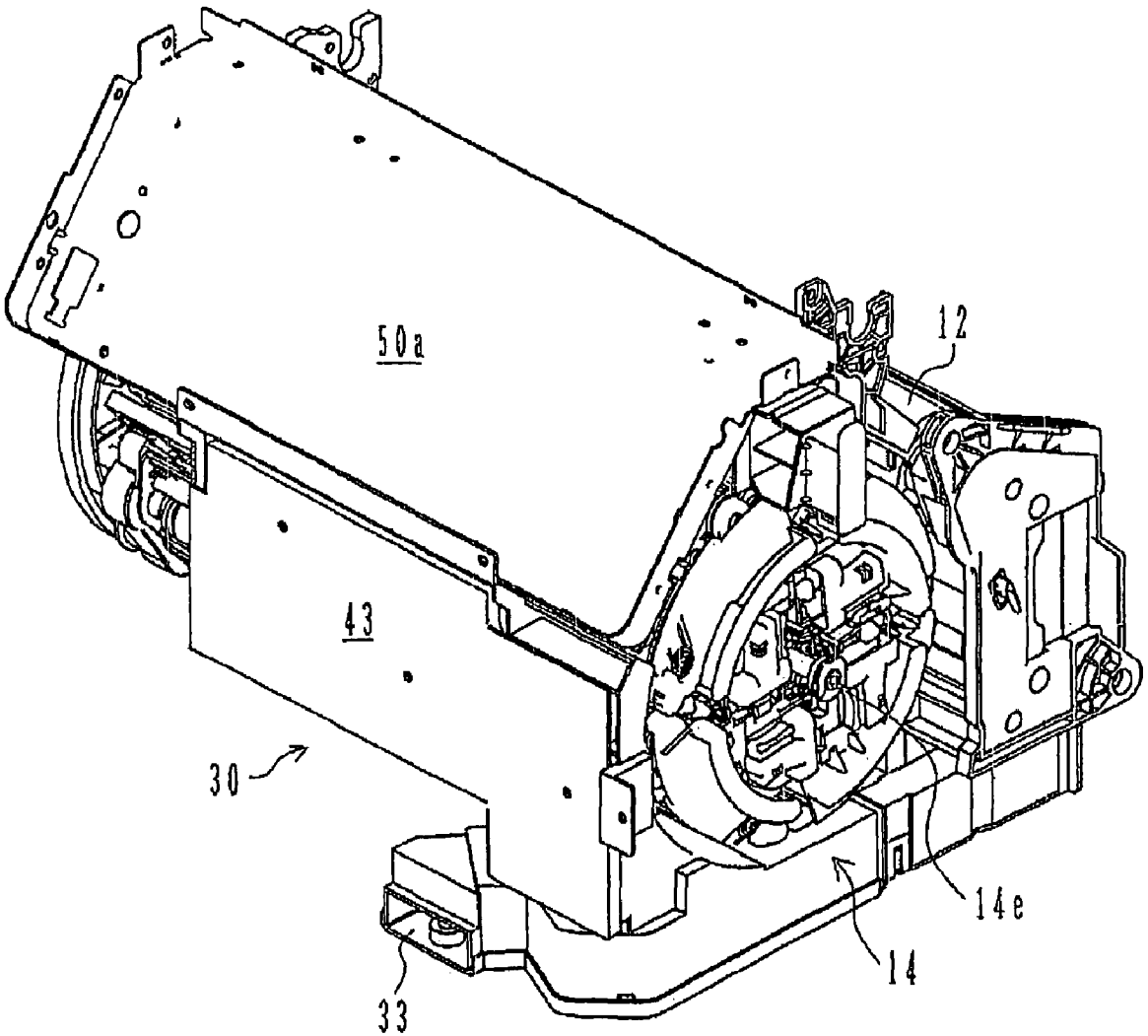
FIG. 3 is a perspective view showing components of the image-forming apparatus.
Figure 4:
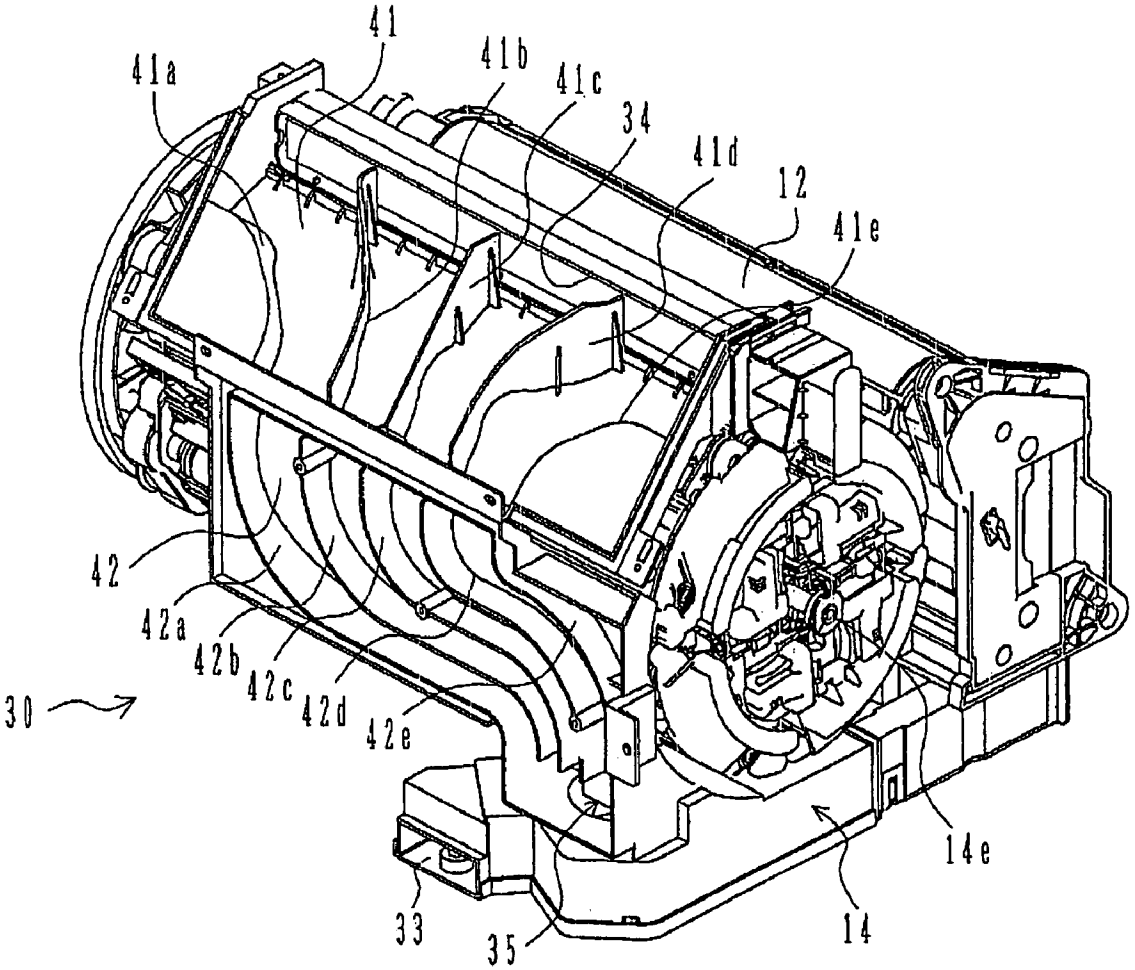
FIG. 4 is a perspective view showing the configuration of the components of FIG. 3.

Briefly, in relation to the exhaust duct 30, the transfer unit cover 25*a*, the power cover 50*a*, and the duct plates 41 to 43 are manufactured such that the first to third paths 32*a* to 32*c* of the exhaust path 32 cover the outer peripheral cover 14*f* (an outer peripheral surface) of the rotary development device 14. As shown in FIG. 3, the transfer unit cover 25*a*, the power cover 50*a*, and the duct plate 41 cover a space in a main-scanning direction above the rotary development device 14. The duct plates 42, 43 interposed between the side exterior cover 20 and the rotary development device cover the space on the side of the rotary development device 14.

By means of the above-described configuration, the inlet 31 of the exhaust duct 30 sucks, by way of the inlet 31, air in the vicinity of the development device of the rotary development device 14, and splashing toner is removed from the air by use of the filter 34 through adsorption. The air is exhausted from the exhaust port 33. In addition, the exhaust duct 30 widely covers a space from a position above the exterior surface of the rotary development device 14 to a position below the side exterior cover 20. When the rotary development device 14 forms an image, for example, the noise caused by rotational operation for switching the development cartridge 14*a* in the development position where the development cartridge faces the photosensitive drum 12; especially, the noise leaking out of the rotary development device through the side exterior cover 20, can be blocked (shielded), thereby diminishing noise.

Figure 6:
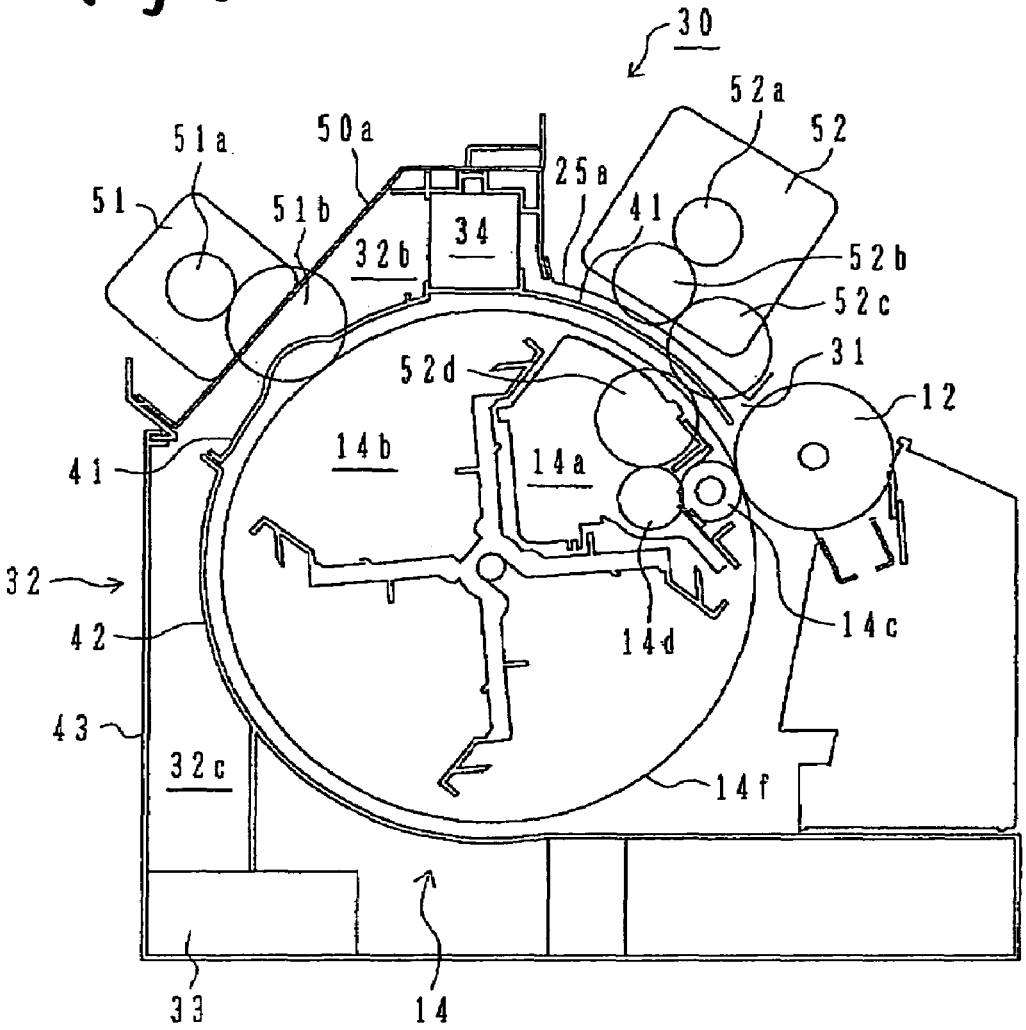
FIG. 6 is an enlarged perspective front view showing the configuration of the image-forming apparatus.

In addition, The exhaust duct 30 covers, in a screening manner, a heat-producing element in the apparatus; e.g., a space from the power board 50 for supplying power to individual sections of the apparatus to the exterior surface of the main body section of the rotary development device 14. As shown in FIG. 6, the exhaust duct 30 covers, in a screening manner, a space from drive motors 51, 52 of the rotary development device 14 to the exterior surface of the main body section of the rotary development device 14.

Specifically, the power board 50 supplies power to individual sections of the apparatus; among others, the power board supplies a heavy current to the drive motor of the laser beam scanner 11 and to the drive motor of the photosensitive drum 12 and supplies a heavy current to a heater that heats the pair of fusing rollers 17. The power board entails generation of considerable amounts of heat. However, the exhaust duct 30 is interposed between the power board 50 and the rotary development device 14, and the heat originating from the power board 50 is not directly transmitted to the rotary development device 14. The heat generated by the power board 50 is received by the exhaust duct 30, and heat is transferred from the heated air to an exhaust air (air) flowing through the exhaust duct 30. Thus, the heat can be removed, thereby preventing the toner stored in the development cartridge 14*a* of the rotary development device 14 from being affected by heat.

The drive motor 51 of the rotary development device 14 causes a drive gear 51*a* fixed to a rotary shaft to mesh with a transmission gear 51*b* formed in the shape of a gear and on an outer periphery of one end of the exterior cover 14*f* of the rotary development device 14, thereby rotationally driving the entirety of the rotary development device 14. For this reason, the heavy current from the power board 50 is consumed to thus generate heat. Also, the drive motor 52 causes a drive gear 52*a* fixed to the rotary shaft to mesh with a drive gear of the supplying roller 14*d* by way of transmission gear trains 52*b* to 52*d*. In addition, a drive gear of the development roller 14*c* is engaged with a drive gear of the supplying roller 14*d*. The supplying roller 14*d* and the development roller 14*c* are rotated at high speed, so that power of the heavy current from the power board 50 is consumed, to thus generate heat. However, the exhaust duct 30 is present between the drive motors 51, 52 and the rotary development device 14, and the heat generated from the drive motors 51, 52 is not transmitted directly to the rotary development device 14. The heat generated by the drive motors 51, 52 is received by the exhaust duct 30, and heat is transferred from the heated air to the exhaust air flowing through the inside of the exhaust duct 30. Thus, heat can be removed, and the toner stored in the development cartridge 14*a* of the rotary development device 14 can be protected from the influence of heat.

The power board 50 is housed in the power cover 50*a* that defines the second path 32*b* of the exhaust path 32. This power cover 50*a* is formed from material having superior heat conductivity; e.g., a metal plate such as a steel plate. By means of this configuration, the heat generated from the power board 50 is efficiently transferred (absorbed) from the air to the exhaust air flowing through the inside of the exhaust duct 30. Thus, the heat is effectively removed, and a rise in the temperature of the neighborhood of the power board is reliably prevented, thereby more reliably protecting the toner in the development cartridge 14*a* from heat. Needless to say, the exhaust duct 30 in not necessarily formed from only the power cover 50*a*, but the entire exhaust duct 30 may be formed from a steel plate. Consequently, the power board 50 can be arranged in a position close to the rotary development device 14, thereby enhancing the degree of freedom in layout.

Figure 5:
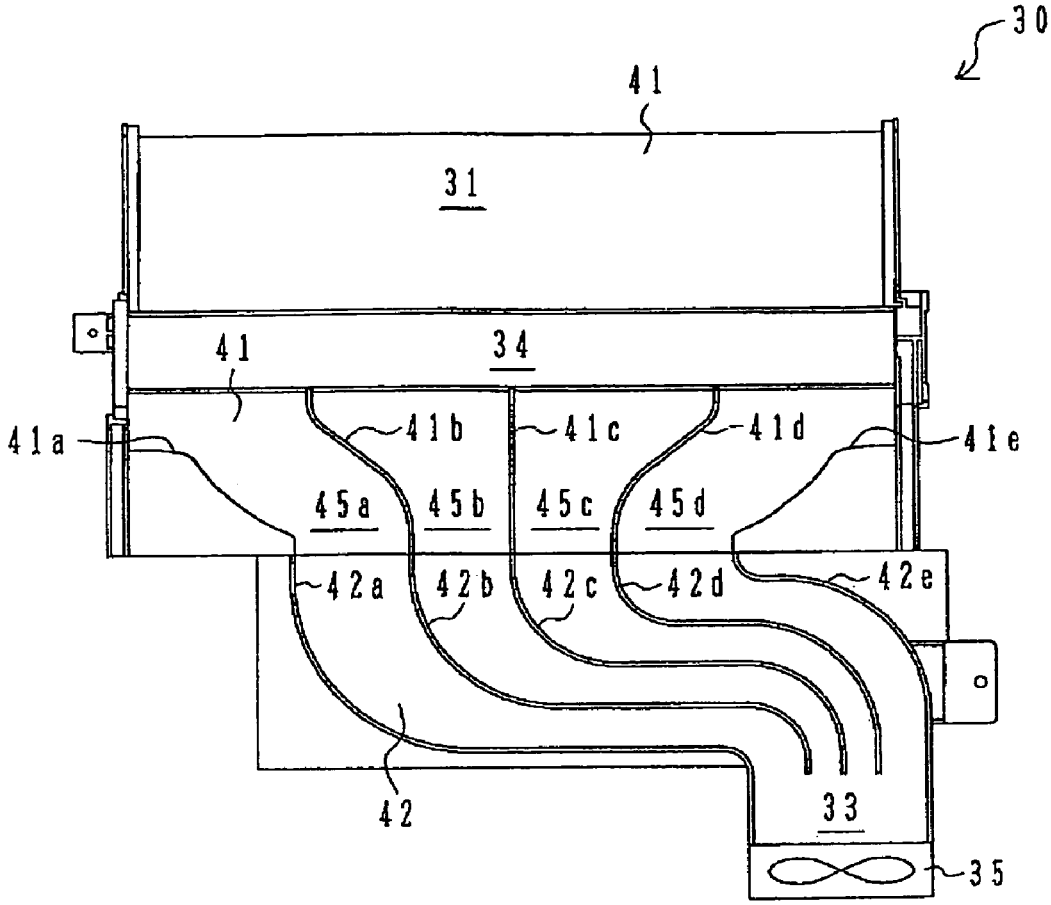
FIG. 5 is a developed plan view showing the configuration of the components.

As shown in FIG. 5, in the exhaust path 32, straightening vanes 41*a* to 41*e* and 42*a* to 42*e*, which are formed into the shapes of ribs heading toward the power cover 50*a* and the duct plate 43, are provided in upright positions on the duct plates 41, 42. The straightening vanes 41*a* to 41*e* and 42*a* to 42*e* divide, into a plurality of passages, the long exhaust passage (the second and third passes 32*b* and 32*c*) extending from the exit of the filter 34 to the position below the side exterior cover 20. The straightening vanes also effect rectification (regulation) so as to narrow the exhaust passage so as to head for the exhaust port 33 arranged on the front side surface of the apparatus main body. For the convenience of layout, the straightening vanes 41*a*, 41*e* are formed into the shape of a wall, wherein both angular portions of the duct plate 41 spaced apart from the filter 34 are levitated so as to ensure a space on the back side (the rotary development device 14). The duct plates 41 to 43 are formed so as to project outwardly beyond the straightening vanes 41*a*, 41*e*, 42*a*, and 42*e* so as to be able to block noise by covering as large the exterior surface of the rotary development device 14 as possible.

The straightening vanes 41*a* to 41*e* are gradually narrowed to the center from the exit of the filter 34 which extends in a depth direction in the same manner as does the inlet 31 of the exhaust duct 30 which sucks air in the vicinity of the development position of the rotary development device 14, such that widths of flow-passage spaces in the depth direction defined between the straightening vanes 41*a* to 41*e* are substantially halved. The straightening vanes 42*a* to 42*e* are provided so as to become continuous with the respective straightening vanes 41*a* to 41*e*, and are headed, from the center in the depth direction, for the exhaust port 33 formed in the front side of the apparatus main body. The widths of flow-passage spaces defined between the straightening vanes 42*a* to 42*e* in the depth direction are narrowed from the inlet 31 to about one-fifth the original width thereof.

The straightening vanes 41*a* to 41*e* and 42*a* to 42*e* define exhaust passages 45*a* to 45*d* from the exit of the filter 34 to the exhaust ports 33; divide the flow-passage spaces defined between the exhaust passages 45*a* to 45*d* such that the volumes of the flow-passage spaces become substantially identical with each other; and narrow the exhaust passages 45*a* to 45*d* in a bending manner so as to converge from the deepest portions thereof to the small exhaust port 33 formed on only the front side. From this configuration, the straightening vanes 41*a* to 41*e* and 42*a* to 42*e* adjust the volumes of the flow-passage spaces of the exhaust passages 45*a* to 45*d* according to the extent of bending of the straightening vanes. In addition to the center exhaust passages 45*b*, 45*c* being bent at two locations; namely, the center and front thereof, the exhaust passages 45*a*, 45*d* provided on the respective sides of the center exhaust passages are bent so as to converge from the exit of the filter 34 toward the center, thus providing a constriction effect. For these reasons, the exhaust passages 45*a*, 45*d* are set such that flow-passage spaces defined thereby have greater volumes than those of the flow-passage spaces defined by the center exhaust passages 45*b*, 45*c*.

As a result, the exhaust duct 30 sucks air around the exit of the filter 34 at uniform pressure by means of the respective exhaust passages 45*a* to 45*d*, thereby efficiently exhausting air. Noise, which is caused by occurrence of a difference in air-volume displacement, can be reduced. In addition, there can be prevented occurrence of a temperature rise, which would otherwise be caused when heat accumulates in the exhaust path 32 of the exhaust duct 30 as a result of a difference having arisen in the amounts of exhaust air.

As mentioned above, in the embodiment, the exhaust duct 30 is provided so as to cover the side exterior cover 20 from the upper side of the rotary development device 14. Accordingly, the noise stemming from driving operation of the rotary development device 14 can be blocked by the exhaust duct 30. An image can be silently formed without provision of a custom-designed sound-shielding material. Consequently, occupation of a space or occurrence of cost hike, which would otherwise be caused by a custom-designed sound-shielding material, can be prevented by use of the exhaust duct 30. Thus, silencing of the image-forming apparatus can be realized inexpensively. In addition, before the heat generated by the power board 50 and the drive motors 51, 52 transfers to the development cartridges 14*a* in the rotary development device 14, the heat can be dissipated by means of the exhaust flowing through the exhaust duct 30. The toner stored in the development cartridges 14*a* can be effectively protected from the influence of the heat (a temperature rise) without provision of a custom-designed heat insulating material. Therefore, a high-quality image can be formed with high reliability by diverting use of the exhaust duct 30 without involvement of the custom-designed heat insulating material occupying a space or contributing to cost hike.

Figure 7:
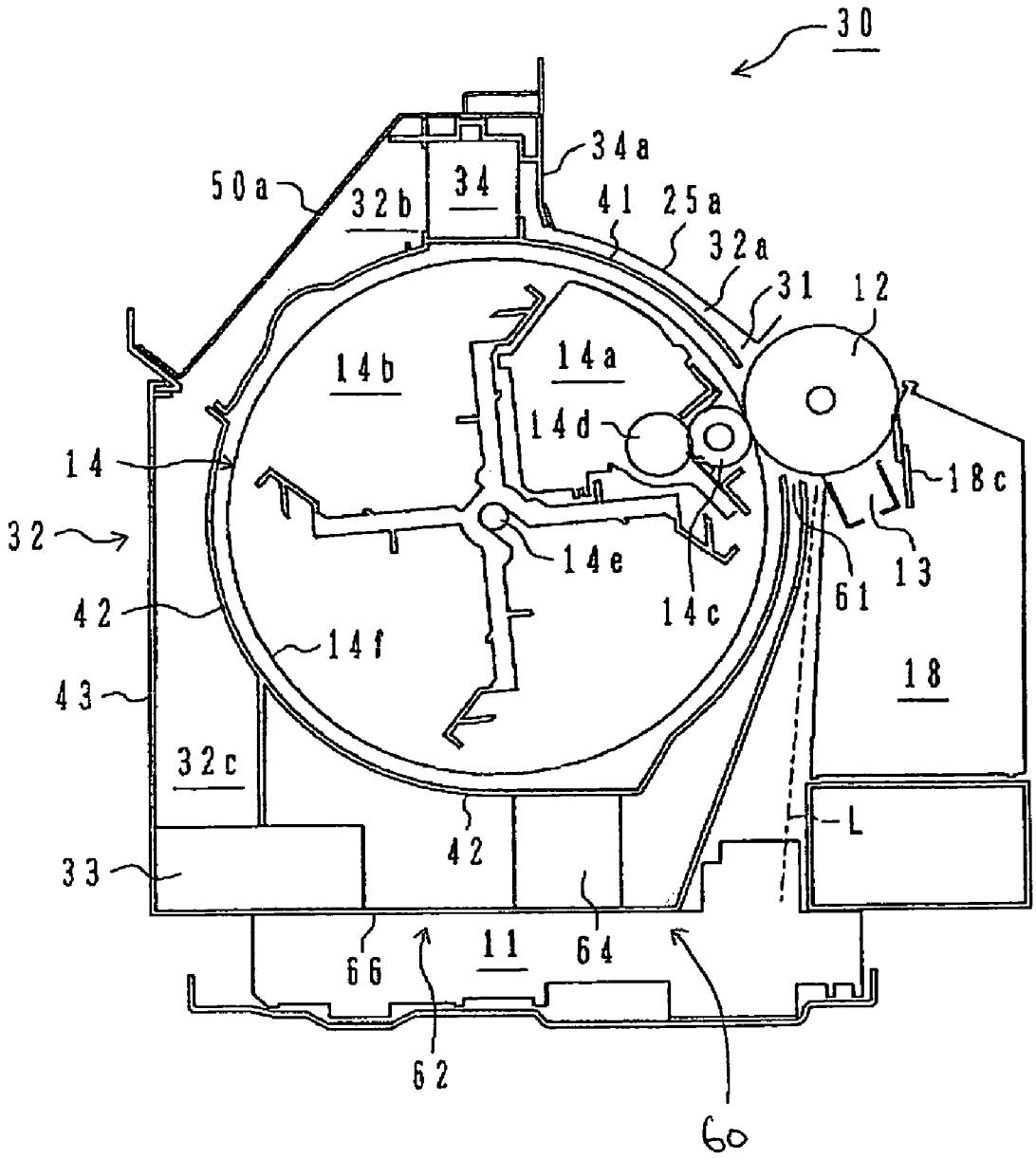
FIG. 7 is a view showing an embodiment of an image-forming apparatus according to the present invention, or an enlarged perspective front view showing the entire configuration of the image-forming apparatus.

Next, FIG. 7 is a view showing a second embodiment of the image-forming apparatus of the present invention. Since the embodiment is substantially identical in configuration with the previously-described embodiment, corresponding constituent elements are assigned the same reference numerals, and only characteristic portions of the constituent elements are described (the same also applies to any counterparts in other embodiments which will be described below).

In FIG. 7, the image-forming apparatus also has an exhaust duct 60 in addition to having the exhaust duct 30.

In contrast with the exhaust duct 30 having the inlet 31 which is disposed in an upper position in the vicinity of the development position of the rotary development device 14, the exhaust duct 60 has an inlet 61 provided at a lower position in the vicinity of the development position (a position upstream of the development roller 14*c* and the photosensitive drum 12 with respect to their rotational directions). As in the case of the exhaust duct 30, a filter 64 for adsorbing and removing the sucked toner is provided in an exhaust path 62 subsequent to the inlet 61, and provided continuous with the exhaust port 33 such that the centrifugal fan 35 is shared between the exhaust ducts 30 and 60.

The exhaust path 62 runs downward between the rotary development device 14 and the waste toner tank 18 from the inlet 61. As a result, the exhaust duct 60 makes a detour so as to cover the lower portion of the apparatus and is made continuous with the exhaust port 33 after having covered the internal side surface of the apparatus adjacent to the outer peripheral cover 14*f* of the rotary development device 14. Needless to say, the exhaust duct 60 is interposed between the rotary development device 14 and the waste toner tank 18 so as not to interfere with an optical path of the laser beam L emitted from the laser beam scanner 11.

In relation to the exhaust path 62, the duct plate 42 defining the exhaust path 32, which is another path, is extended to cover a lower side of the outer peripheral cover 14*f* of the rotary development device 14 to the side surface of the same. Further, a duct plate 66 is placed and defined so as to face the duct plate 42. As in the case of the exhaust path 32, the plate 66 extends in a depth direction and covers the entirety of the rotary development device 14 from the side thereof to the lower portion thereof.

By means of this configuration, the exhaust duct 60 sucks, by way of the inlet 61, air from a lower area in the vicinity of the development position of the rotary development device 14, and exhausts, from the exhaust port 33, the air from which the spilled toner has been removed by the filter 64 through adsorption. In addition, the exhaust duct 60 can largely cover the exterior surface of the rotary development device 14 from the inner side of the device to the position below the side exterior cover 20 where the exhaust port 33 is provided. When the rotary development device 14 forms an image, the noise caused by, e.g., rotational operation for switching the development cartridge 14*a* to face the photosensitive drum 12; especially, the noise leaking out of the apparatus by way of a lower part thereof, can be diminished. Moreover, in addition to the power board 50 and the drive motors 51, 52, which are heat-producing elements in the apparatus, this exhaust duct 60 covers, in a screening manner, the exterior surface of the main body of the rotary development device 14 from the laser beam scanner 11.

Specifically, the laser optical scanner 11 comprises an unillustrated laser oscillator which emits a laser beam L, and a polygon scanner which rotates at super high speed so as to deflect the laser beam L in a scanning manner. For this reason, the laser beam scanner involves generation of a certain amount of heat. The exhaust duct 60 is interposed between the laser beam scanner 11 and the rotary development device 14, and the heat generated by the laser beam scanner 11 is not transmitted directly to the rotary development device 14. The heat generated by the laser beam scanner 11 is received by the exhaust duct 60, and the heat is then exchanged from the exhaust duct to the exhaust flowing therethrough, thereby removing the heat. Thus, the toner stored in the development cartridges 14*a* of the rotary development device 14 does not undergo the influence of heat.

As in the case of the exhaust path 32, straightening vanes are provided in the exhaust path 62, thereby forming a plurality of divided exhaust passages, and the exhaust passages are rectified (regulated) so as to become narrow toward the exhaust port 33.

As mentioned above, in addition to having the exhaust duct 30 of the exhaust path 32 covering the space from the position above the rotary development device 14 to the side exterior cover 20, the present embodiment is provided with the exhaust duct 60 of the exhaust path 62 which covers the space from the internal side surface of the rotary development device 14 to the position below the same. Therefore, in addition to yielding the working-effects yielded by the previous embodiments, the present embodiment enables great coverage of substantially the entire exterior surface of the rotary development device 14, and leakage of noise stemming from driving operation of the rotary development device 14 can be effectively blocked, thereby diminishing noise. The exhaust ducts 30, 60 perform sucking and exhausting operations by use of one centrifugal fan 35 while using the exhaust port 33 as a common port. Accordingly, the spaces close to the inlets 31, 61 are not occupied by the exhaust fan, thereby improving the degree of freedom in laying out other components. Moreover, in addition to avoiding the influence of the heat of the power board 50 and the drive motors 51, 52, the toner stored in the development cartridge 14*a* effectively avoids the influence of heat generated by the laser beam scanner 11 (a temperature rise), so that a high-quality image can be formed with greater reliability.

Figure 8:
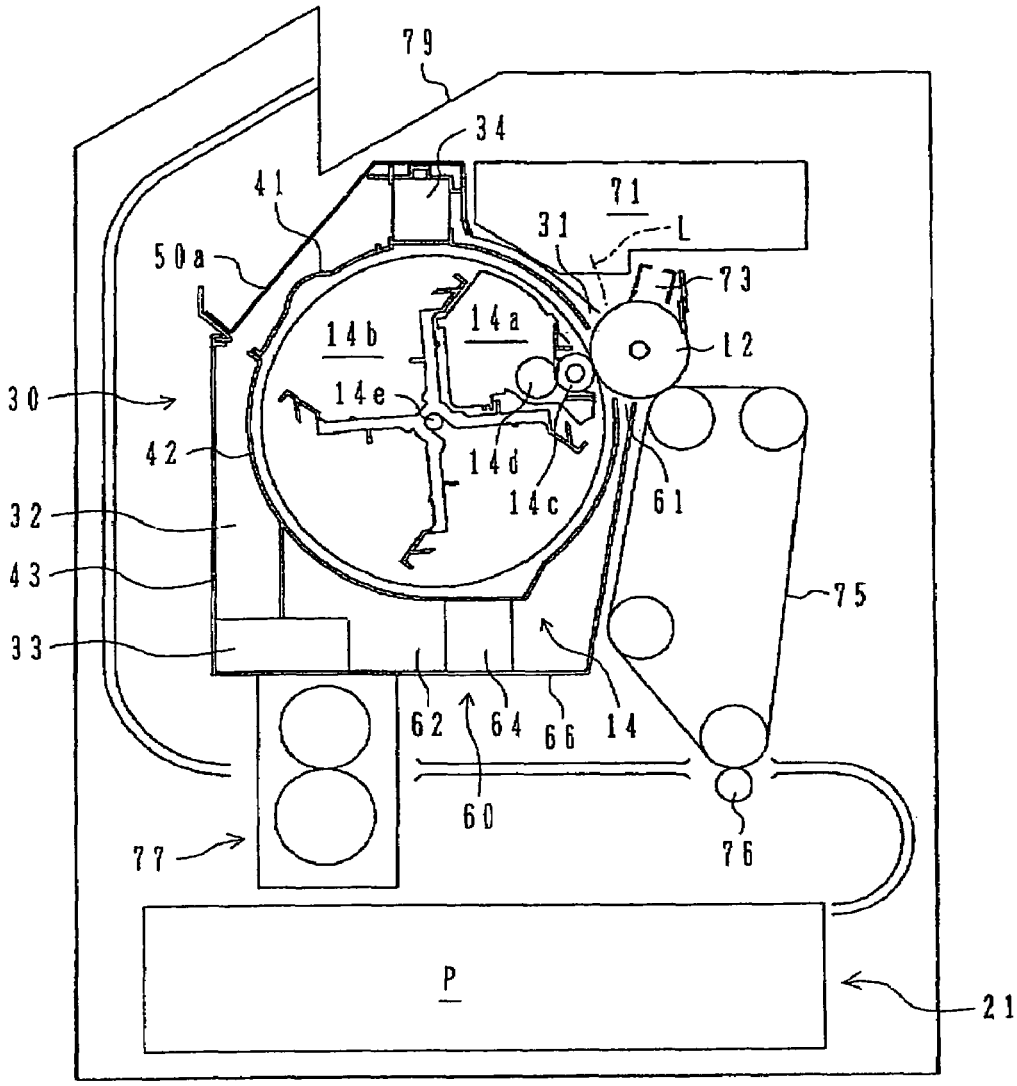
FIG. 8 is a view showing an embodiment of an image-forming apparatus according to the present invention, or an enlarged perspective front view showing the schematic entire configuration of the image-forming apparatus.

FIG. 8 is a view showing a third embodiment of the image-forming apparatus according to the present invention.

In FIG. 8, as in the case of the above-described embodiment, the image-forming apparatus is formed as having the image recorder and the paper transporter. In this image-forming apparatus, the recording paper P is caused to pass through the transport path provided on substantially the right side surface of the image-forming apparatus in the above-described embodiments, whereby the recording paper P is transported between the intermediate transfer belt 15, the transfer roller 16, and the pair of fusing rollers 17 in a nipped manner. Thus, an image is formed on one surface of the recording paper. The recording paper P withdrawn from the paper cassette 21 is inverted and transported horizontally. The recording paper P is transported between an intermediate transfer belt 75, a transfer roller 76, and a pair of fusing rollers 77 in a nipped manner, thereby forming an image.

Briefly speaking, the rotary development device 14 and the photosensitive drum 12 form an electrostatic latent image and a toner image by arranging a laser beam scanner 71 and an electrification device 73 on an upper portion of the photosensitive drum 12 in the same layout as in the previously-described embodiments.

The intermediate transfer belt 75 is disposed below the photosensitive drum 12, and is to receive the toner image developed by the rotary development device 14. The recording paper P inversely transported from the inside of the paper cassette 12 is horizontally transported, in its present attitude, while being nipped between the intermediate transfer belt 75 and the transfer roller 76 located below it. Thus, the toner image is transferred.

The pair of fusing rollers 77 are arranged so as to level with the intermediate transfer belt 75 and the transfer roller 76. The recording paper P, which is transported in a nipped manner between the intermediate transfer belt 75 and the transfer roller 76, is subjected to heating and pressurization, whereby the toner image is fused on the surface of the recording paper. Subsequently, the recording paper P is caused to pass through the transport path running along substantially the left side surface of the apparatus, and is transported and output to a paper output table 79 in the upper portion of the apparatus.

Specifically, the exhaust duct 30 is interposed between the rotary development 14 and the power board 50 provided at a higher position and a heat-producing element such as the laser beam scanner 71, and the exhaust duct 60 is interposed between the rotary development device 14 and the pair of fusing rollers 77 provided below it. The pair of fusing rollers 77 heat the recording paper P and have the drive motors to be used for transporting recording paper in a nipped manner, and hence become heat-producing elements. However, as in the case of the previously-described embodiments, the heat generated by the pair of fusing rollers 77 is received by the exhaust duct 60, and the heat is transferred from the exhaust duct 60 to the exhaust air flowing through the exhaust duct, thereby dissipating the heat. The toner stored in the development cartridge 14*a* of the rotary development device 14 is protected from the influence of heat.

As mentioned above, in the present embodiment, even when there is adopted a layout, wherein the pair of fusing rollers 77 are provided below the rotary development device 14, the toner stored in the development cartridges 14*a* can be effectively protected from the influence of the heat generated by the pair of fusing rollers 77 (a temperature rise). Thus, in addition to yielding the working-effect yielded by the second embodiment, the present embodiment yields an advantage of the ability to form a high-quality image with high reliability.

Figure 9:
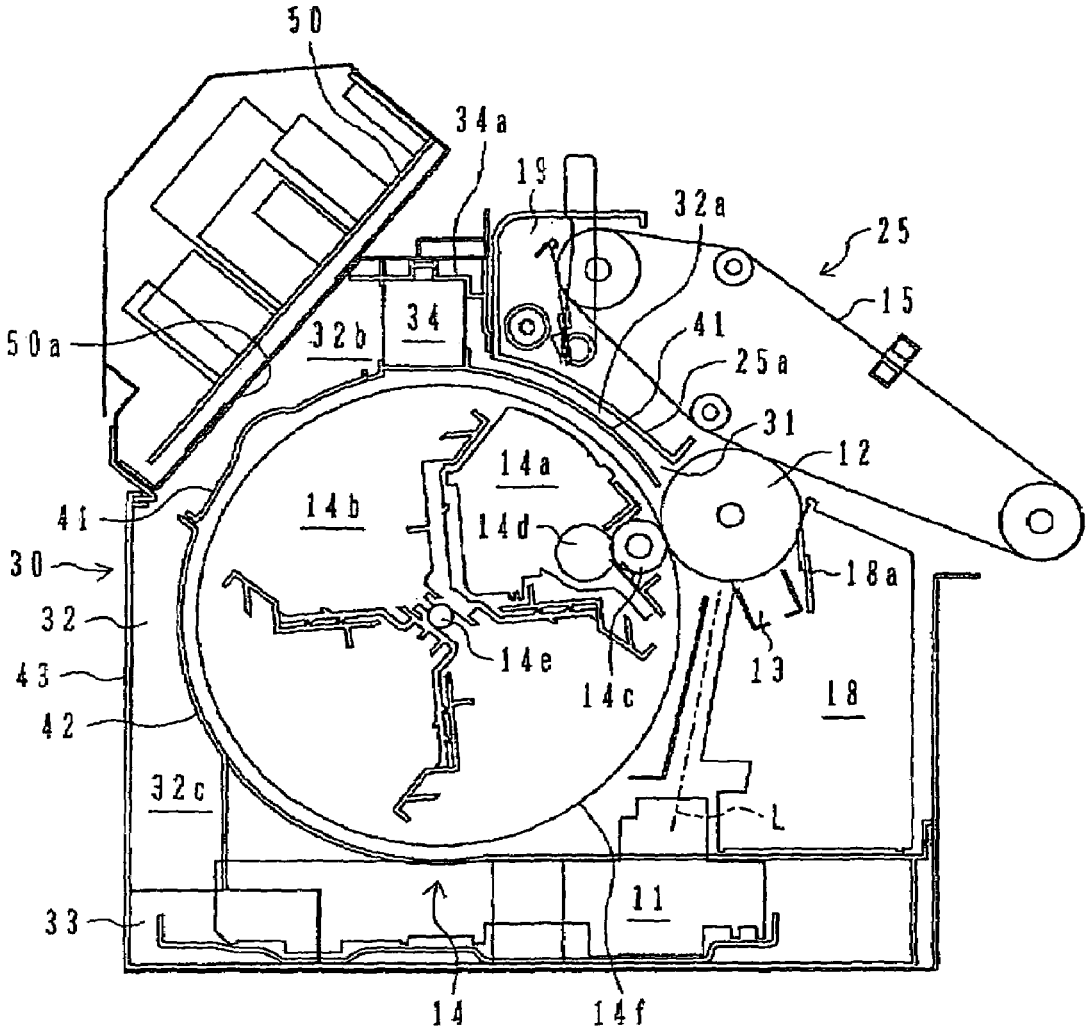
FIG. 9 is a fragmentary enlarged perspective front view showing the configuration of the image-forming apparatus.
Figure 10:
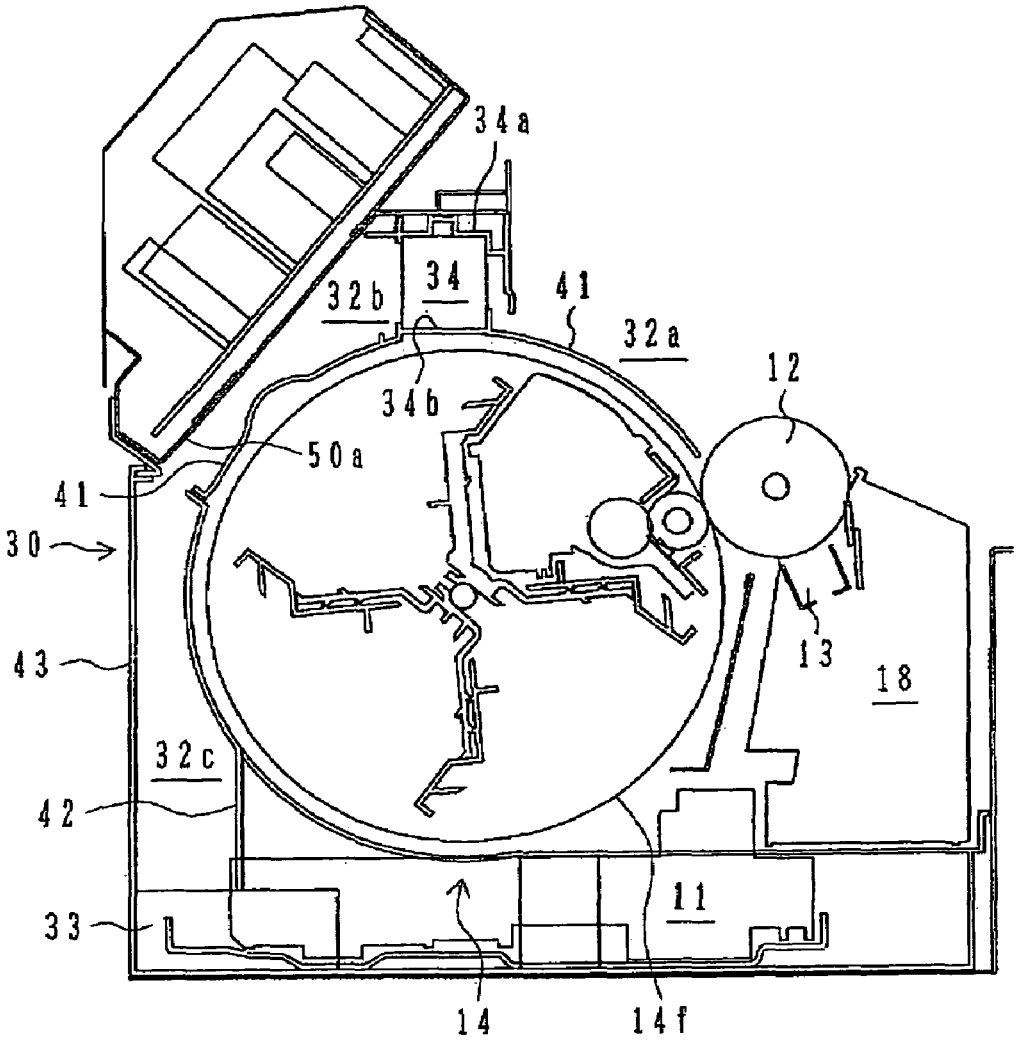
FIG. 10 is a perspective front view showing the state of FIG. 9 achieved during maintenance.

FIGS. 9 and 10 are drawings showing a fourth embodiment of an image-forming apparatus according to the present invention.

In the exhaust duct 30, the transfer unit cover 25*a*, which faces the duct plate 41 and constitutes the first path 32*a* of the exhaust path 32, comes into intimate contact with the upper exterior portion 34*a* of the filter 34 in a removably attachable manner, thereby defining the exhaust path (see FIG. 9). As shown in FIG. 10, during maintenance of the adjacent intermediate transfer unit 25, the transfer unit cover 25*a* is integrally attached to the intermediate transfer unit, and detached from the duct plate 41. Specifically, during maintenance of the intermediate transfer unit 25, the exhaust duct 30 can open the exhaust path of the first path 32*a*, which extends from the inlet 31 to the filter 34, to the outside.

As a result, at the time of maintenance of the intermediate transfer unit 25, the exhaust duct 30 can be subjected to maintenance, such as cleaning, for removing the toner accumulated on the transfer unit cover 25*a* or the inside of the duct plate 41. When the intermediate transfer unit 25 is set in the main body of the apparatus after maintenance, the transfer unit cover 25*a* opposes the duct plate 41, thereby defining a clean exhaust passage in the exhaust path 32 (the first path 32*a*) close to the inlet 31 in the exhaust duct 30.

As mentioned above, in the present embodiment, when the intermediate transfer unit 25 adjacent to the space above the exhaust duct 30 is removed during maintenance, the exhaust passage in the first path 32*a* of the exhaust path 32 can be opened, thereby simultaneously enabling maintenance for removing accumulated toner. Consequently, simultaneously with maintenance of the intermediate transfer unit 25, the inside of the exhaust passage can be cleaned without awareness of timing for maintenance of the exhaust duct 30. Thus, contamination of the inside of the apparatus, which would otherwise be caused when accumulated toner is spilled by impact, can be prevented.

Figure 11:
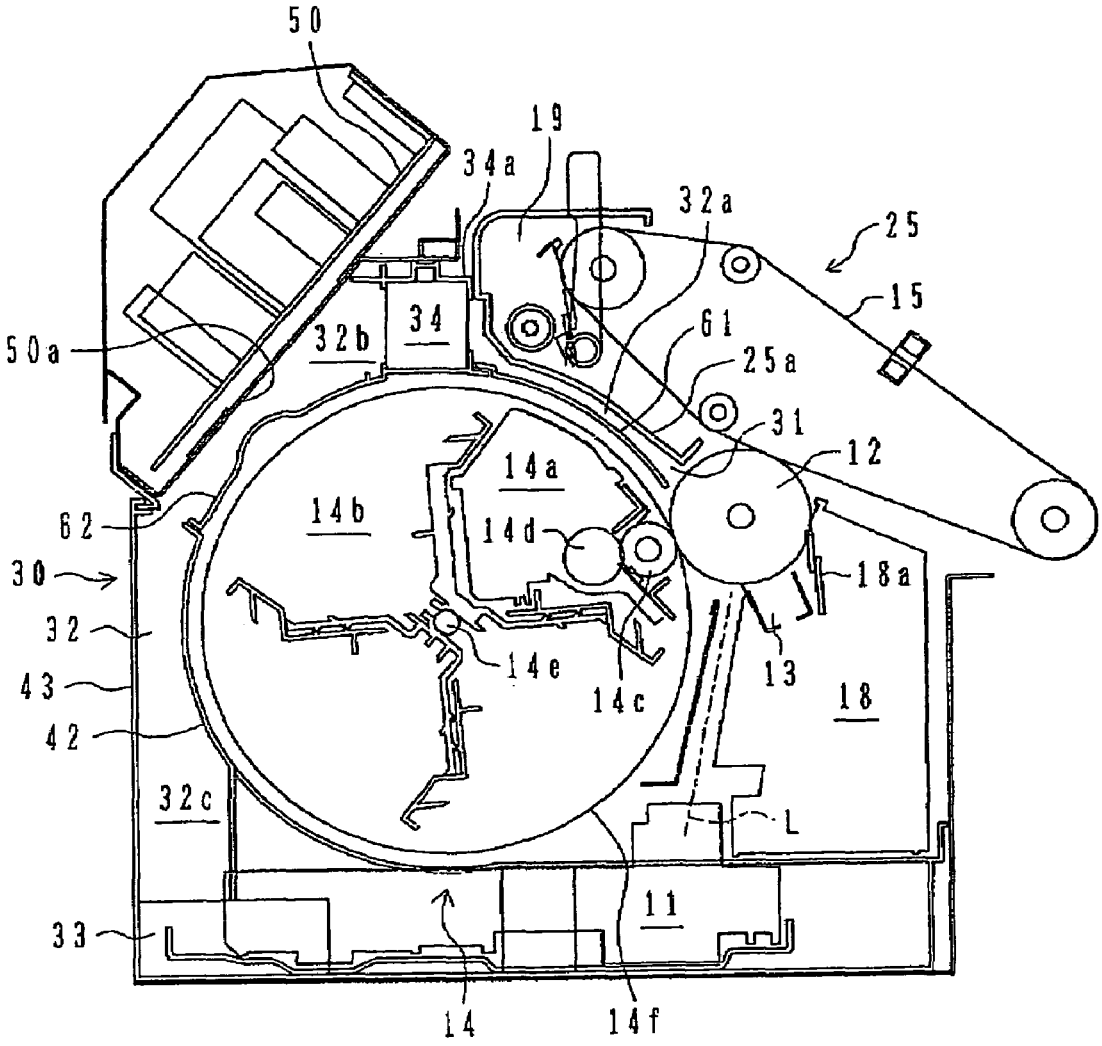
FIG. 11 is a view showing an embodiment of an image-forming apparatus according to the present invention, or a fragmentary enlarged perspective front view showing the configuration of the image-forming apparatus.
Figure 12:
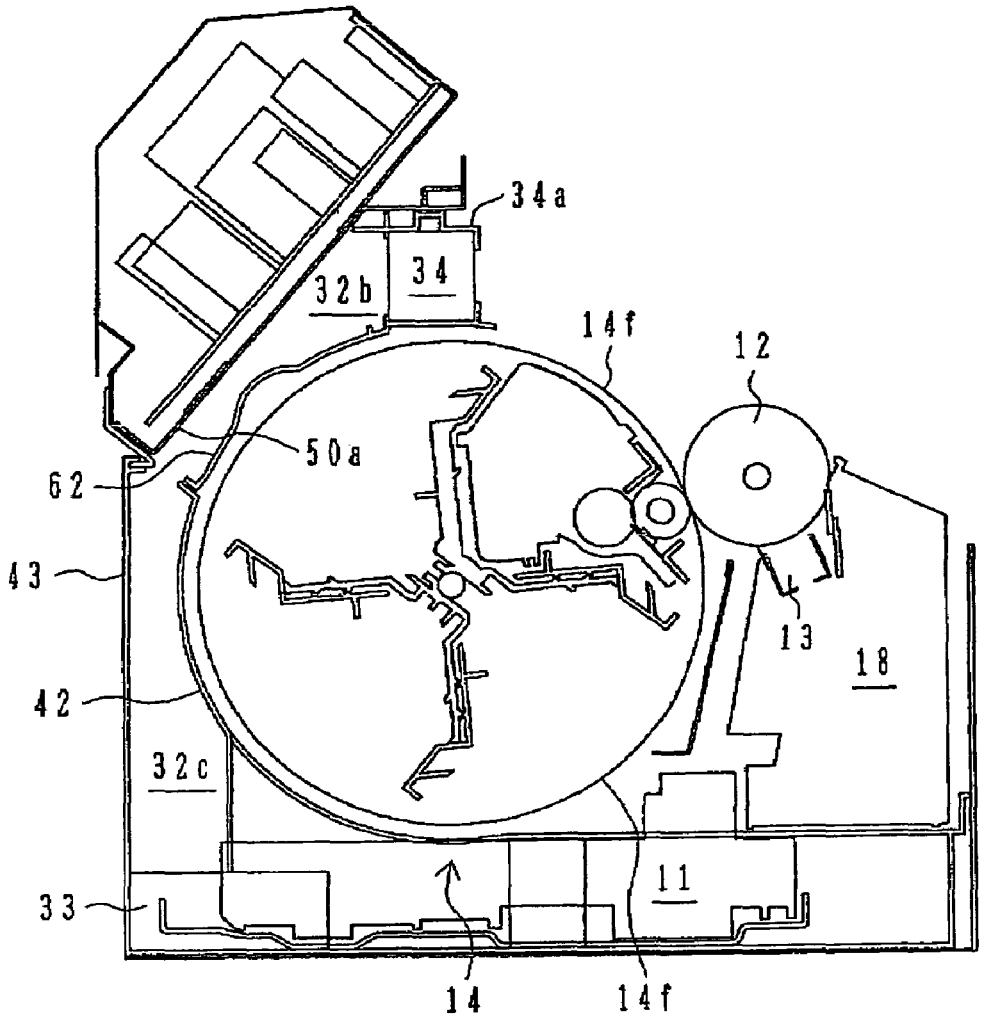
FIG. 12 is a perspective front view showing the state of FIG. 11 achieved during maintenance.

FIGS. 11 and 12 are views showing a fifth embodiment of the image-forming apparatus of the present invention.

In FIG. 11, as in the case of the fourth embodiment, the image-forming apparatus is configured to have an image recorder and a paper recorder. The exhaust duct 30 of the image-forming apparatus is removably attached to the entire first path 32*a* of the exhaust path 32.

Specifically, in the exhaust duct 30 of the present embodiment, the first path 32*a* and the second path 32*b*, both belonging to the exhaust path 32, are constituted of separate members; namely, duct plates 61, 62 formed by dividing the duct plate 41 of the fourth embodiment into two pieces.

The duct plate 61 opposes the transfer unit cover 25*a* of the intermediate transfer unit 25 to thus constitute the first path 32*a* that extends from the inlet 31 to the filter 34 as well as to define the exhaust passage. As in the case of the transfer unit cove 25*a*, the duct plate 61 is removably attached to the part of the main body of the apparatus close to the intermediate transfer unit 25, and to the intermediate transfer unit 25, as well.

The duct plate 62 faces the power cover 50*a* of the power unit 50, thereby constituting the second path 32*b* that extends from the filter 34 to the location connected to the third path 32*c* and defining the exhaust passage of the second path. The duct plate is divided into the duct plates 61, 62 such that the duct plate 62 functions also as an lower exterior of the filter 34.

Specifically, in relation to the duct plates 61, 62, like the transfer unit cover 25*a* coming into intimate contact with the upper exterior 34*a* of the filter 34 in a detachable/attachable manner, the duct 61 removably comes into intimate contact with the duct plate 62 as the exterior of the filter 34, thereby defining the exhaust passage of the first path 32*a*.

As shown in FIG. 12, the duct plate 61 is integrally attached/detached in conjunction with the adjacent intermediate transfer unit 25 during maintenance of the intermediate transfer unit 25. Subsequently, the duct plate 61 is removed from the intermediate transfer unit 25, as well. Thus, the duct plate 61 is separated from the transfer unit cover 25*a*, thereby opening the exhaust passage of the first path 32*a*, which extends from the inlet 31 to the filter 34, to the outside. The shape of the transfer unit cover 25*a* and that of the exterior 34*a* slightly differ from those of the counterparts in the above-described embodiments, for reasons of design (the same also applies to any counterparts in subsequent embodiments which will be described below).

From the descriptions, the exhaust duct 30 can be subjected to maintenance operation, such as cleaning, for removing the toner accumulated on the interior surface of the transfer unit cover 25*a* and that of the duct plate 61 at a location differing from the location where the main body of the apparatus is provided, simultaneously with maintenance of the intermediate transfer unit 25. When the duct plate 61 is attached to the intermediate transfer unit 25 after maintenance, the intermediate transfer unit 25 is set in the main body of the apparatus. As a result, the duct plate 61 and the transfer unit cover 25*a* oppose each other, thereby defining a clean exhaust passage within the exhaust path 32 (the first path 32*a*) in proximity to the inlet 31.

As mentioned above, in addition to yielding the working-effect yielded by the above-described fourth embodiment, the present embodiment yields the ability to remove the entire first path 32*a* of the exhaust path 32 during maintenance of the intermediate transfer unit 25, whereupon the duct plate 61 opposes the transfer unit cover 25*a*, to thus open the exhaust passage constituting the first path. Maintenance operation, such as removal of accumulated toner, can be performed outside the apparatus. Consequently, there is eliminated the risk of the inside of the main body of the apparatus being stained by the maintenance operation of the exhaust duct 30, thereby making the inside of the exhaust passage clean.

Figure 13:
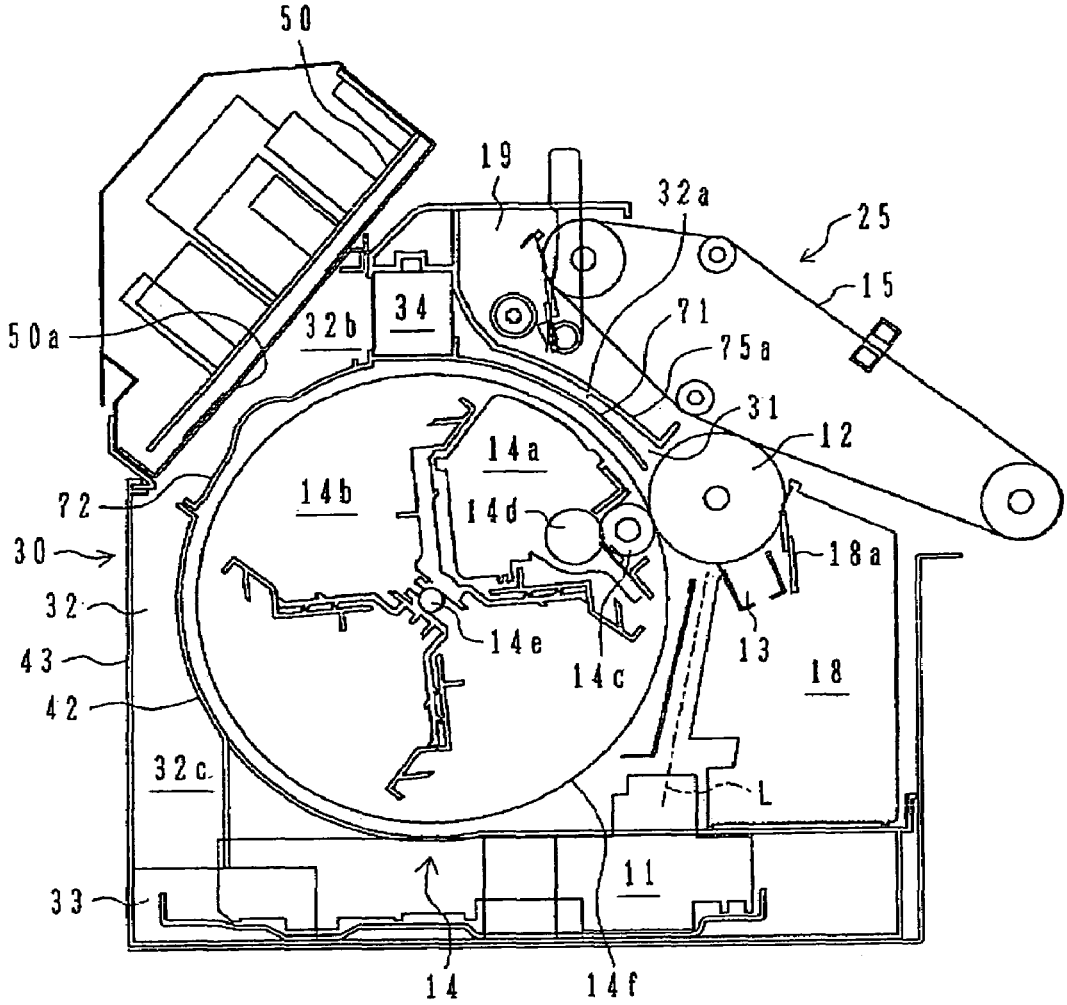
FIG. 13 is a view showing an embodiment of an image-forming apparatus according to the present invention, or a fragmentary enlarged perspective front view showing the configuration of the image-forming apparatus.
Figure 14:
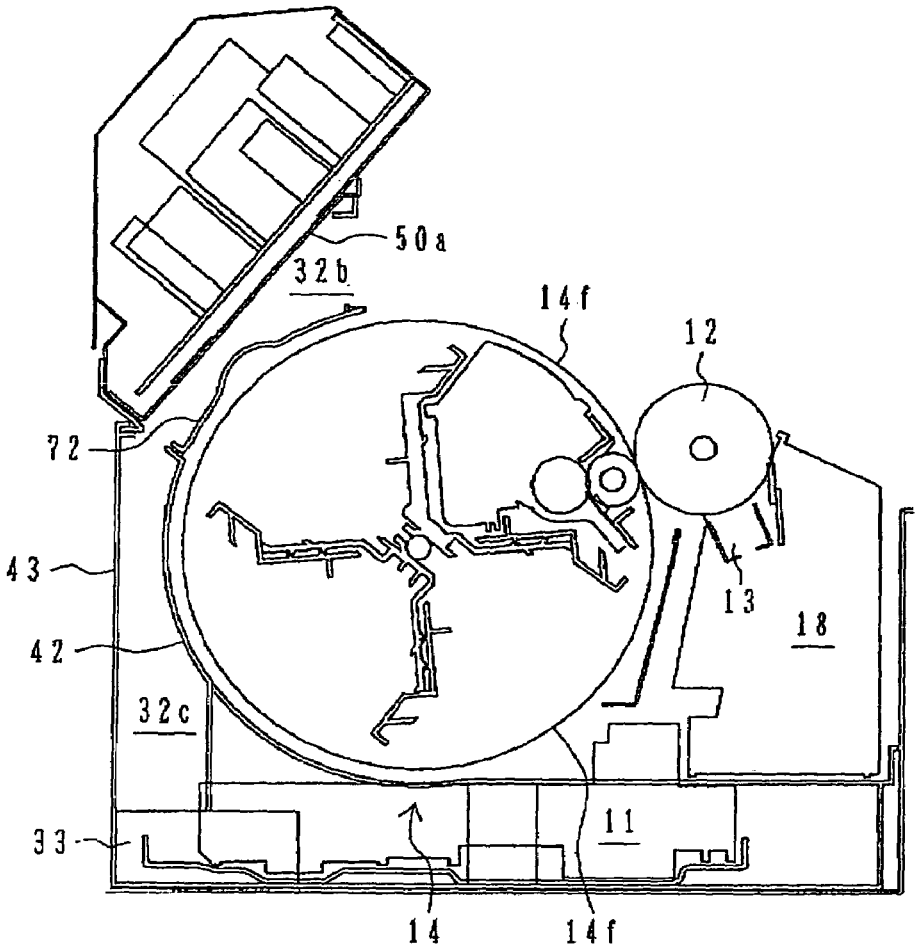
FIG. 14 is a perspective front view showing the state of FIG. 13 achieved during maintenance.
Figure 15:
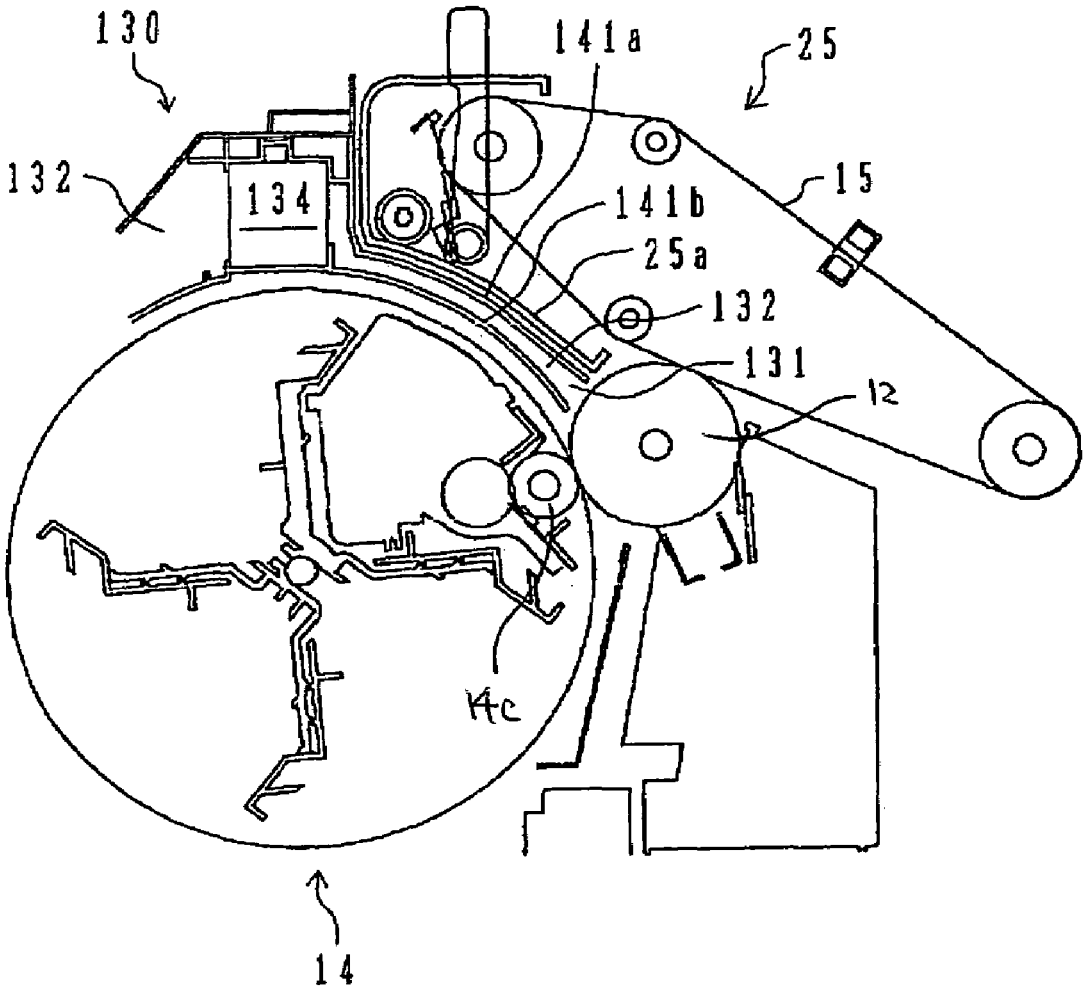
FIG. 15 is a fragmentary enlarged perspective front view showing the principal configuration of the related image-forming apparatus.
Figure 16:
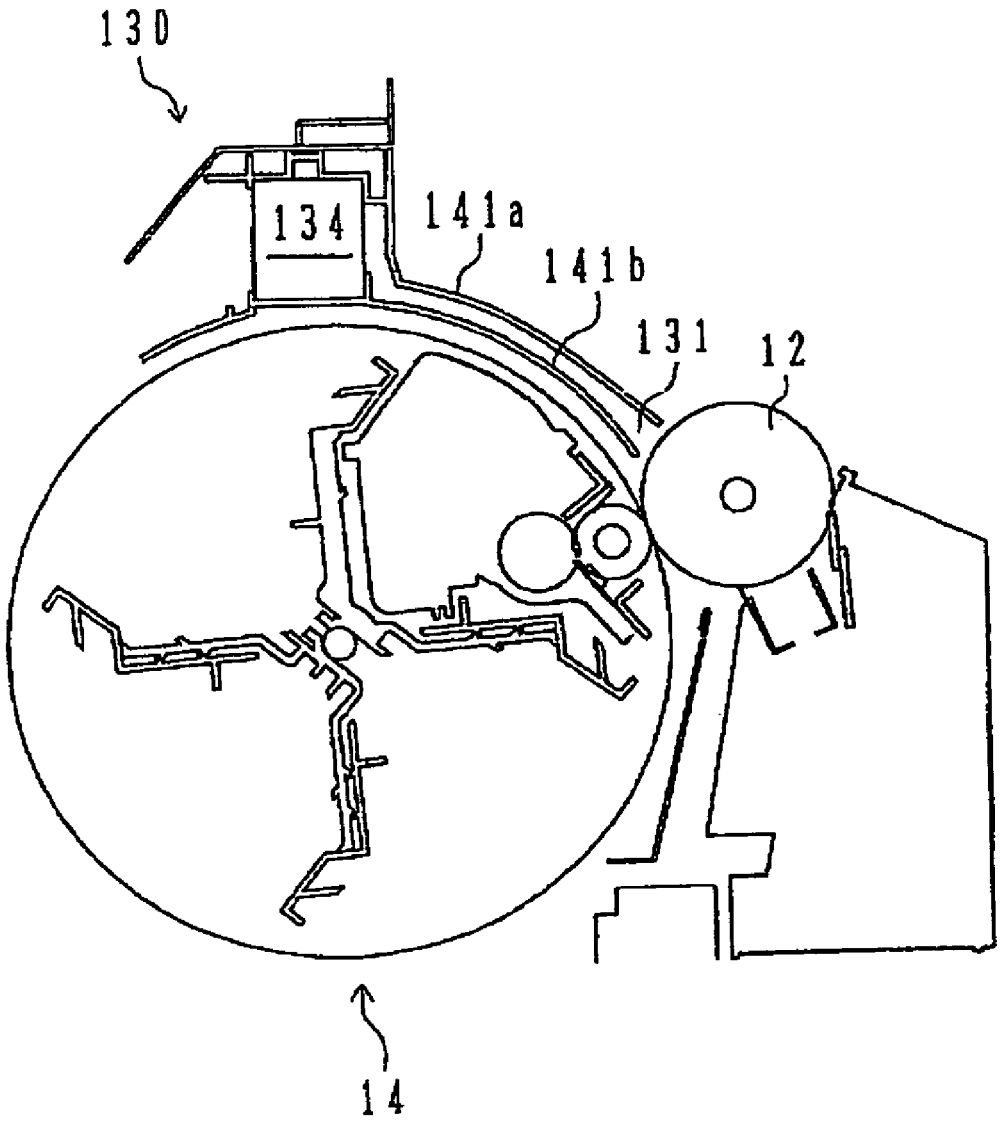
FIG. 16 is a perspective front view showing the state of FIG. 15 achieved during maintenance.

FIGS. 13 and 14 are views showing a third embodiment of the image-forming apparatus of the present invention.

In FIG. 13, as in the case of the above-described fourth embodiment, the image-forming apparatus is configured as having the image recorder and the paper transporter. The exhaust duct 30 of the image-forming apparatus is configured so as to enable removable attachment of the filter 34 in conjunction with the entire first path 32*a* of the exhaust path 32.

Specifically, the exhaust duct 30 of the present embodiment is configured such that separate duct plates 71, 72 formed by dividing the duct plate 41 of the fourth embodiment into two pieces form the first path 32*a* and the second path 32*b*, both belonging to the exhaust path 32. The intermediate transfer unit 25 is provided with a transfer unit cover 75*a* which is extended so as to contact or depart from the power cover 50*a* of the power board 50 and also functions as an upper exterior of the filter 34.

The duct plate 71 faces the transfer unit cover 75*a* of the intermediate transfer unit 25, thereby constituting the first path 32*a* that extends from the inlet 31 to the filter 34. Thus, the exhaust passage of the first path is defined. Like the transfer unit cover 75*a*, the duct plate 71 is attached to the intermediate transfer unit 25 so as to be removably attached to the main body of the apparatus, as well as being removably attached to the intermediate transfer unit 25. The duct plate is divided into the duct plates 71, 72 such that the duct plate 71 also acts as the lower exterior of the filter 34.

The duct plate 72 faces the power cover 50*a* of the power unit 50, thereby constituting the second path 32*b* which extends to a location where the filter 34 is continuous with the third path 32*c*. Thus, the exhaust passage of the second path is defined.

The duct plate 71 is extended to act as a lower exterior of the filter 34, and the transfer unit cover 75*a* is extended to act as an upper exterior of the filter 34. Put another way, the duct plate 71 and the transfer unit cover 75*a* are extended so as to sandwich the filter 34. The transfer unit cover 75*a* comes into intimate contact with the power cover 50*a* in a removably attachable manner, and the duct plate 71 comes into intimate contact with the duct plate 72 in a removably attachable manner, thereby defining the exhaust passage of the first path 32*a*.

As a result, as shown in FIG. 12, the duct plate 71 is removed in conjunction with the adjacent intermediate transfer unit 25 during maintenance thereof. Subsequently, the duct plate 71 is removed from the intermediate transfer unit 25, as well. Thus, the duct plate 71 is separated from the transfer unit cover 25*a* in conjunction with the filter 34, thereby opening to the outside the exhaust passage of the first path 32*a* from the inlet 31 to the filter 34.

As a result, the exhaust duct 30 can be subjected to operation, such as cleaning, for removing the toner accumulated on the interior surface of the transfer unit cover 75*a* and the interior surface of the duct plate 71 simultaneously with maintenance of the intermediate transfer unit 25, and the filter 34 can be subjected to maintenance for performing cleaning or replacement, at a position separate from the location of the main body of the apparatus. In the exhaust duct 30, the filter 34 and the duct plate 71 are attached to the intermediate transfer unit 25 after maintenance. As a result of the intermediate transfer unit 25 being attached to the main body of the apparatus, the duct plate 71 and the transfer unit cover 75*a* oppose each other, thereby defining a clean exhaust passage in the exhaust path 32 (the first path 32*a*) close to the inlet 31.

As mentioned above, in the present embodiment, in addition to yielding the working-effect yielded in the fourth embodiment, there is yielded an advantage of the ability to remove the filter 34 along with the entire first path 32*a* of the exhaust path 32 during maintenance of the intermediate transfer unit 25. Maintenance operation for removing the accumulated toner by opening the exhaust passage defined as a result of the duct plate 71 and the transfer unit cover 75*a* opposing each other and maintenance operation for replacing the filter 34 can be performed outside the main body of the apparatus. Consequently, the inside of the main body of the apparatus is prevented from being stained by maintenance of the exhaust duct 30. The inside of the exhaust passage can be made clean, and the exhaust capability of the exhaust duct 30 can be recovered.

Although the embodiments of the present invention have been described thus far, the present invention is not limited to these embodiments. Needless to say, the present invention can be carried out in various different forms within the concept of the present invention. For instance, the image-forming apparatus is not limited to a printer, but it goes without saying that the present invention can also be applied to a facsimile and a copier, which utilize electrophotography.

What is claimed is:

1. An image forming apparatus comprising:

an image carrier on which an electrostatic latent image is formed;

a plurality of development cartridges, each of which includes toner and is adapted to face the image carrier at a development position, and each of which causes the toner to adhere onto the image carrier to develop the electrostatic latent image as a toner image;

a development device configured to be rotatable around a rotational axis thereof, the development device housing the plurality of development cartridges around the rotational axis; and a duct including an inlet port through which air in the vicinity of the development position is sucked and an outlet port from which the sucked air is exhausted to the outside of the image forming apparatus, wherein at least a part of the duct is defined by a detachable unit that is located in close proximity to the development device, the duct is defined by a pair of opposing plates, and the detachable unit includes one of the plates so that the one of the plates is detachable from the image forming apparatus together with the detachable unit.

2. The image forming apparatus according to claim 1, wherein the duct is defined by a pair of opposing plates, and the pair of opposing plates is operable to detach from the image forming apparatus together with the detachable unit.

3. The image forming apparatus according to claim 1, wherein the duct has a filter therein, the filter absorbs toner included in the sucked air, and the filter is operable to detach from the image forming apparatus together with the detachable unit.

* * * * *